US006623384B2

(12) United States Patent
Kanemitsu

(10) Patent No.: US 6,623,384 B2
(45) Date of Patent: Sep. 23, 2003

(54) DYNAMIC DAMPER AND DYNAMIC DAMPER-INSTALLED TENNIS RACKET

(75) Inventor: Yumi Kanemitsu, Hyogo (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 09/956,906

(22) Filed: Sep. 21, 2001

(65) Prior Publication Data

US 2002/0058557 A1 May 16, 2002

(30) Foreign Application Priority Data

Sep. 21, 2000 (JP) ..... 2000-287034

(51) Int. Cl.[7] ..... A63B 49/02
(52) U.S. Cl. ..... 473/521; 473/537
(58) Field of Search ..... 473/519, 520, 473/521, 524, 537

(56) References Cited

U.S. PATENT DOCUMENTS 4,139,164 A * 2/1979 Alfio ..... 242/530
4,875,679 A 10/1989 Movilliat et al.
6,293,878 B1 9/2001 Iwatsubo et al.
2002/0058557 A1 * 5/2002 Kanemitsu ..... 473/520

FOREIGN PATENT DOCUMENTS

| | | | |
|---|---|---|---|
| JP | 52-13455 | | 4/1977 |
| JP | 52-156031 | | 12/1977 |
| JP | 3228779 | | 10/1991 |
| JP | 263876 | | 9/1992 |
| JP | 10-340836 | | 11/1998 |
| JP | 2000157649 | | 9/2001 |
| JP | P2002-48185 A | * | 2/2002 |
| JP | P2002-48186 A | * | 2/2002 |
| JP | P2002-85598 A | * | 2/2002 |

* cited by examiner

*Primary Examiner*—Raleigh W. Chiu
(74) *Attorney, Agent, or Firm*—Birch, Stewart, Kolasch & Birch, LLP

(57) ABSTRACT

A dynamic damper (10) having a viscoelastic part (12) and a mass-adding part (11) laminated on the viscoelastic part (12). The dynamic damper (10) has a horizontal frame (13) and a vertical frame (14) disposed at both sides of the horizontal frame (13) in such a way that the horizontal frame (13) and the vertical frame (14) continuous with the horizontal frame (13) in the shape of a lattice. The horizontal frame (13) and the vertical frame (14) are integral with each other or separately provided in the shape of a lattice.

19 Claims, 25 Drawing Sheets

Prior art

Prior art

Prior art

DYNAMIC DAMPER AND DYNAMIC DAMPER-INSTALLED TENNIS RACKET

FIELD OF THE INVENTION

The present invention relates to a dynamic damper and a dynamic damper-installed tennis racket for improving shock and vibration characteristic thereof which are generated when we hit a ball with the tennis racket.

DESCRIPTION OF THE RELATED ART

The dynamic damper (vibration-damping member) having a viscoelastic part and a mass-adding part connected to the viscoelastic part is often used to reduce and relieve shock and vibrations generated in sports ball-hitting goods and tools when they are used. In the tennis rackets disclosed in Japanese Patent Publication No.52-13455 and Japanese Patent Application Laid-Open Nos.52-156031 and 4-263876, the cantilevered dynamic damper having a load-applying material fixed thereto through the elastic material is installed on the tennis racket. The dynamic damper resonates with vibrations of the racket frame to damp its vibration.

More specifically, in Japanese Patent Publication No.52-13455, as shown in FIG. 23, the cantilevered damper 6 consisting of the long and narrow elastic material is installed at the end of the grip 5. The base of the steel wire 6*b* having a weight 6*a* installed on its front end is embedded in the racket frame. In Japanese Patent Application Laid-Open No.52-156031, as shown in FIG. 24, the base 3*a* of the dynamic damper is fixed to the throat 4 of the tennis racket, and the body 3*c* of the dynamic damper is connected to the base 3*a* via the neck 3*b* to vibrate the body 3. In Japanese Patent Application Laid-Open No.4-263876, as shown in FIG. 25, the load-applying member 4*b* is fixed to the grip end 5*a* of the tennis racket via the elastic member 4*a*.

In the above-described proposed conventional tennis rackets, to mainly suppress the 1st vibration of the racket frame in the out-of-plane direction (direction perpendicular to the gut plane of the racket frame), the configuration of the dynamic damper and the fixing position thereof are designed. That is, the load-applying material is fixed to the front end of one elastic material whose one end is fixed to the racket frame. The dynamic damper vibrates at the same frequency as that of the racket frame, thus consuming energy and reducing and damping the vibration and shock of the racket frame rapidly.

However, a player feels not only the vibration of the tennis racket in the out-of-plane direction but also the vibration thereof in the in-plane direction (widthwise direction of the racket frame parallel with the face of the racket frame). When the player hits a ball with at a position apart from the axis of the racket frame, the player feels a shock generated by the rotation of the grip very unpleasant.

The vibration in the in-plane direction has not been considered much. The vibration of the gut-stretched part in the in-plane direction is generated by deformation of the gut which hits the ball directly, thus giving a big influence on the player's evaluation on her/his ball-hitting feeling, namely, on whether the player feels good or bad when the player hits the ball with the tennis racket.

It is said that a so-called large racket having a large face area (area of gut-stretched part) developed to fly the ball a long distance generates more unpleasant vibration than a tennis racket having a small face area. This is because the large racket is liable to flex in the in-plane direction owing to the large face area. That is, the vibration of the gut-stretched part in the in-plane direction is large. From these facts, in the tennis racket such as the large racket designed to fly the ball a long distance, it is important to reduce the vibration in the in-plane direction in addition to the vibration in the out-of-plane direction.

Therefore the present applicant proposed a sectionally U-shaped dynamic damper as disclosed in Japanese Patent Application Laid-Open No.10-340836. The dynamic damper having the configuration can favorably reduce the vibration of the gut-stretched part in the in-plane direction in addition to its vibration in the out-of-plane direction.

The sectionally U-shaped dynamic damper can increase the vibration-damping performance in the in-plane direction in addition to that in the out-of-plane direction. But there is a case in which the effect for damping the vibration of the racket frame in the out-of-plane direction is smaller than that for damping the vibration thereof in the in-plane direction. To improve the vibration-damping performance, the dynamic damper has a room for improvement.

SUMMARY OF THE INVENTION

The present invention has been made in view of the above-described problems. Thus it is a first object of the present invention to provide a dynamic damper superior in relieving and reducing shock and vibrations.

It is a second object of the present invention to provide a dynamic damper-installed tennis racket reducing vibrations of the racket frame in the in-plane direction in addition to the out-of-plane direction and having a vibration damping factor of not less than 1% in the in-plane direction and in the out-of-plane direction to reduce burden on a player's arm and allow a player to have a favorable feeling when the player hits a ball with the tennis racket.

To achieve the object, according to the present invention, there is provided a dynamic damper which comprises a viscoelastic part and a mass-adding part integrally layered on the viscoelastic part and is installed on a racket. The dynamic damper has a horizontal frame and a vertical frame disposed at both sides of the horizontal frame in the shape of a lattice. In the construction, the horizontal frame and the vertical frame are integrally formed or formed by joining the horizontal frame and the vertical frame separate from each other, the horizontal frame is installed on at least one surface of the racket in a thickness direction thereof, and the vertical frame is installed on both surfaces of the racket in a widthwise direction thereof.

The thickness direction of the racket means the direction perpendicular to the gut-stretched surface thereof. The widthwise direction of the racket means the direction parallel to the gut-stretched surface.

The horizontal frame is bent in the shape of a letter "U". One end of a bent portion disposed at both sides of the horizontal frame is integral with the vertical frame or joined therewith. The bent portion disposed at both sides of the horizontal frame is installed on both surfaces of the racket in its widthwise direction.

It is preferable that the number of the horizontal frames is not less than two and that the horizontal frames are disposed, with the horizontal frames sandwiching a gut insertion hole therebetween. Thus in the case where the dynamic damper has two horizontal frames, it is rectangular. In the case where the dynamic damper has three horizontal frames, it has the shape of a Japanese character "日". In the case where the dynamic damper has four horizontal frames, it has the shape of a Japanese character "目".

That is, the lattice-shaped dynamic damper of the present invention has the long and narrow vertical frame integral with the horizontal frame or separate vertical frame and horizontal frame are jointed with each other.

As described above, the horizontal frame and the vertical frame are continuous and integral with each other and disposed in the shape of a lattice. Therefore in the dynamic damper-installed racket, the vertical frame resonates mainly with vibrations of the racket frame in a out-of-plane direction, whereas the horizontal frame resonates mainly with vibrations of the racket frame in a in-plane direction, thus effectively reducing vibrations in the out-of-plane direction and the in-plane direction. That is, because the horizontal frame and the vertical frame are disposed in the shape of a lattice, the dynamic damper has improved vibration-damping performance, thus reducing of shock and vibrations.

In the case where the dynamic damper is formed monolithically in the shape of a lattice, i.e., in the case where the vertical frame and the horizontal frame are formed integrally with each other in the shape of a lattice, the entire lattice resonates with the vibration of the racket frame in the in-plane direction, thus having an effect of reducing the vibration in the in-plane direction. That is, in the case where the horizontal frame and the vertical frame are formed integrally with each other in the shape of a lattice, the weight of the entire dynamic damper contributes to the reduction of the vibration of the racket frame in the in-plane direction and the out-of-plane direction, thus having a higher vibration reduction effect than that brought about by the horizontal frame contributing to the reduction of the vibration of the racket frame in the in-plane direction and the vertical frame contributing to the suppression of the vibration thereof in the out-of-plane direction. That is, the dynamic damper having the construction is superior in its vibration-damping performance.

Favorably the ratio of the length (L2) of the vertical frame to the length (L1) of the horizontal frame is not less than 0.3 nor more than 1.0. This is because if the ratio L2/L1 is less than 0.3, the region for vibrating the dynamic damper in the out-of-plane direction is so small that the effect of damping the vibration of the racket frame in the out-of-plane direction is small. On the other hand, if the ratio L2/L1 is more than 1.0, the weight of the entire dynamic damper becomes large. Thus it is difficult for a player to swing the tennis racket and for the entire dynamic damper to vibrate in the in-plane direction in particular. More favorably the ratio L2/L1 is not less than 0.6 nor more than 0.9. The length of the horizontal frame and the vertical frame means the length thereof at the center of the thickness of the dynamic damper.

It is preferable that the longitudinal direction of the vertical frame is set along the longitudinal direction (the longitudinal direction of the horizontal frame is perpendicular to the gut plain of the racket frame) of the racket frame. In this case, the dynamic damper can display excellent vibration-damping performance.

It is favorable that the width of each portion of the viscoelastic part is not less than 4 mm nor more than 8 mm. If the width of the viscoelastic part is less than 4 mm, the viscoelastic part is narrow in order to adhesion to an object such as the racket frame on which the viscoelastic part installed. If the width of the viscoelastic part is more than 8 mm, the dynamic damper is heavy. Consequently the vibration of the dynamic damper is bad, which causes the dynamic damper to have a low effect of damping the vibration of the racket frame. It is more favorable that the width of the viscoelastic part is not less than 4 mm nor more than 6 mm.

It is favorable that the thickness of each portion of the viscoelastic part is set to not less than 2.5 mm nor more than 5.5 mm. If the thickness of the viscoelastic part is set to less than 2.5 mm, it is difficult for the viscoelastic part to vibrate. On the other hand, if the thickness of the viscoelastic part is set to more than 5.5 mm, the viscoelastic part may be an interference when the dynamic damper is installed on the racket frame or the dynamic damper looks unattractive. It is more favorable that the thickness of each portion of the viscoelastic part is set to not less than 3 mm nor more than 5 mm.

The total weight of the dynamic damper is set to not less than 8 g nor more than 23 g. If the total weight of the dynamic damper is set to less than 8 g, the dynamic damper has an insufficient vibration reduction performance. On the other hand, if the total weight of the dynamic damper is set to more than 23 g, the racket frame has poor handling performance.

The complex modulus of elasticity of the viscoelastic part at 20° C. and 10 Hz is set to not less than 0.3 MPa nor more than 1.5 MPa. A solid material having a complex modulus of elasticity less than 0.3 MPa and suitable for being installed on an object such as the tennis racket to which it is installed does not exist. On the other hand, if the complex modulus of elasticity of the viscoelastic part is more than 1.5 MPa, the frequency of the dynamic damper of the present invention is incapable of resonating with that of an object such as the tennis racket to which the dynamic damper is installed.

The complex modulus of elasticity of the mass-adding part at 20° C. and 10 Hz is set to not less than 100 MPa nor more than 800 MPa.

A mass-adding part having a complex modulus of elasticity not less than 100 MPa nor more than 800 MPa is not as soft as the viscoelastic part but softer than a hard metal and elastic. Because the dynamic damper of the present invention is composed of the mass-adding part having a certain degree of softness and the very soft viscoelastic part, there is no fear that it hurts or injures a player's hand even though it collides with the hand. That is, there is no fear that the dynamic damper deteriorates safety. In the case where the mass-adding part is soft, even though the viscoelastic part and the mass-adding part are integral with each other by the connection between the surfaces thereof, the viscoelastic part is not constrained strongly by the mass-adding part. Further the mass-adding part as well as the viscoelastic part is capable of deforming. Thus the entire dynamic damper generates a dynamic motion and a resonant phenomenon in a sufficient degree, thus sufficiently relieving and reducing shocks and vibrations.

If the mass-adding part is a hard rigid body, only the viscoelastic part is capable of deforming. When the viscoelastic part is integral with the mass-adding part by the connection between the surfaces thereof, the viscoelastic part is constrained strongly by the mass-adding part. Thus the dynamic damper is incapable of generating the dynamic motion and the resonant phenomenon sufficiently. Thus the dynamic damper is incapable sufficiently displaying an action of relieving and reducing shocks and vibrations.

If the complex modulus of elasticity of the mass-adding part of the dynamic damper of the present invention is less than 100 MPa, it is impossible to secure a specific gravity as the mass-adding part to have a sufficient mass-adding effect.

On the other hand, if the complex modulus of elasticity of the mass-adding part is more than 800 MPa, the mass-adding part does not have a required degree of softness. If the complex modulus of elasticity of the mass-adding part is less than 300 MPa, the mass-adding part has a sufficient degree of softness. Thereby the dynamic damper is capable sufficiently displaying an action of relieving and reducing shock and vibrations. Therefore it is more favorable that the complex elastic modulus of the mass-adding part is less than 300 MPa.

The complex modulus of elasticity of the viscoelastic part and that of the mass-adding part are measured in the following conditions:

Measuring instrument: Viscoelastic Spectrum Graphy DVE-V4FT Rheospectrer manufactured by RHEOLOGY Corp.

Initial load: 250 g

Frequency: 10 Hz

Displacement amplitude: 5 $\mu$m

Direction: pulling

Temperature: 20° C.

Distance between chucks: 30 mm

It is preferable that the thickness of the entire dynamic damper, namely, the total thickness of the viscoelastic part and the mass-adding part is set to not less than 3.0 mm nor more than 7.0 mm. If the thickness of the entire dynamic damper is less than 3.0 mm, it is difficult for the dynamic damper to vibrate. If the thickness of the entire dynamic damper is more than 7.0 mm, the dynamic damper may be an interference when the dynamic damper is installed on the racket frame or the dynamic damper looks unattractive.

The mass-adding part of the dynamic damper of the present invention may be composed of metal. But it is preferable that the main components of the mass-adding part consist of metal powder having a high specific gravity and a highmolecular compound such as resin, rubber or elastomer and the mixture that the metal powder having a high specific gravity is dispersed in the macromolecular material.

In the case where the mass-adding part contains the highmolecular compound, the viscoelastic part of the present invention contains a highmolecular compound identical or similar to the highmolecular compound for the mass-adding part.

Elastic modulus-adjusting oil and/or moldability-improving oil may be added to the mixture of the metal powder having a high specific gravity and the highmolecular compound. A coloring pigment may be also added to the mixture.

The metal powder having a high specific gravity is not limited to specific metals. But metals having a specific gravity not less than five nor more than 25 at 20° C. can be preferably used. If the specific gravity of the mass-adding part is less than 5, its volume is too large to allow it to have a sufficient mass-adding action. If the specific gravity thereof is more than 25, metal which can be used is rare and expensive or difficult to obtain. Thus the following metals can be used: iron (specific gravity: 7.86), copper (8.92), lead (11.3), nickel (8.85), zinc (7.14), gold (19.3), platinum (21.4), osmium (22.6), iridium (22.4), tantalum (16.7), silver (10.5), chromium (7.19), brass (8.5), and tungsten (19.3). Zinc is harmful. Gold, silver, and the like are expensive. Thus tungsten, copper, nickel, and alloys thereof are preferable. It is preferable to surface-treat the metal powder having a high specific gravity with a coupling agent (for example, silane coupling coating) to allow it to have high degree of adhesion to the macromolecular material.

It is preferable that the diameter of the particle of the metal powder having a high specific gravity is not less than 1 $\mu$m nor more than 250 $\mu$m. If the particle diameter is less than 1 $\mu$m, the metal powder is liable to fly or flocculate. Thus the metal powder is difficult to disperse in the highmolecular compound when they are mixed. If the particle diameter is more than 250 $\mu$m, i.e., if the metal powder is large, it is difficult to make the mass-adding part thin.

As the highmolecular compound for the viscoelastic part and the mass-adding part, thermoplastic resin and thermosetting resin are used. The thermoplastic resin includes polyamide resin, polyester resin, urethane resin, polycarbonate resin, ABS resin, polyvinyl chloride resin, polyacetate resin, polyethylene resin, polyvinyl acetate resin, and polyimide resin. The thermosetting resin includes epoxy resin, unsaturated polyester resin, phenol resin, melamine resin, urea resin, diallyl phthalate resin, polyurethane resin, and polyimide resin. The thermoplastic resin is more favorable than the thermosetting resin in consideration of moldability and because it can be recycled.

The thermoplastic elastomer is softer than thermoplastic resin and has higher rubber elasticity, and a lower degree of plastic deformation. Further the thermoplastic elastomer can be recycled. Furthermore it is easy to tune the frequency of the dynamic damper with that of the racket frame. Therefore the thermoplastic elastomer is particularly preferable as the highmolecular compound for the mass-adding part. That is, it is easy to obtain the mass-adding part having a proper complex elastic modulus from a mixture in which the metal powder, having a high specific gravity, serving as the main component is dispersed in the thermoplastic elastomer also serving as the main component.

Although the thermoplastic elastomer is not limited to specific ones, styrene elastomer, olefin elastomer, urethane elastomer, and ester elastomer can be used. The following thermoplastic elastomers are commercially available: Septon compound produced by Kuraray Plastic Corp., Highbla and Septon produced by Kuraray Corp., Elastage produced by Toso Corp., Neat polymer produced by Kanekafuchi Kagaku Kogyo Corp, Nuberan produced by Teijin, Elastomer AR produced by Aron Kasei Corp., Clayton D and Clayton G produced by Shell Japan, Pelprene produced by Toyo Boseki, Toughtech produced by Asahi Kasei Kogyo, Sumiflex, Moldex, Spidex, Sumicon RM produced by Sumitomo Bakelite Corp., Surmoran and Labaron produced by Mitsubishi Kasei Corp., Sumitomo TPE, Sumitomo TPE-SB produced by Sumitomo Kagaku Corp, Epofriend produced by Daicel Corp., Quintack produced by Nippon Zeon, Santoprene and Tolefusin produced by AES•Japan Corp., and Cirlink produced by DSM Corp.

In the case where the highmolecular compound is used to compose the mass-adding part, it is preferable that the highmolecular compound for the viscoelastic part of the dynamic damper of the present invention is identical or similar to the highmolecular compound for the mass-adding part. Foam material may be used as the highmolecular compound for the viscoelastic part. The highmolecular compound identical or similar to the highmolecular compound for the mass-adding part has a compound melting point to that of the highmolecular compound for the mass-adding part. Thus it is possible to produce the dynamic damper by heating the materials for the viscoelastic part and the mass-adding part in a die to fuse them and integrate them with each other.

The following rubbers are used as the highmolecular compound for the viscoelastic part and the mass-adding part: natural rubber (NR), poly isoprene rubber (IR), butadiene rubber (BR), styrene-butadiene rubber (SBR), chloroprene rubber (CR), acrylonitrile-butadiene rubber (NBR), carboxylated butyl rubber, Isobutylene-Isoprene butyl rubber (IIR), halogenated Isobutylene-Isoprene butyl rubber (X-IIR), ethylene-propylene rubber (EPM), ethylene-propylene-diene rubber (EPDM), ethylene-vinyl acetate rubber (EVA), acrylic rubber (ACM, ANM), ethylene-acrylic rubber, chlorosulfonated polyethylene (CSM), chlorinated polyethylene (CM), epichlorohidrin rubber (CO), urethane rubber, silicone rubber, and fluorinated rubber. If the rubber material for the viscoelastic part and that for the mass-adding part belong to the same family, it is easy to join them to each other by vulcanization, which is suitable for integrating them with each other.

Ethylene.propylene-diene rubber (EPDM) and silicone rubber are preferable because of the weather resistance thereof. Butyl rubber (IIR) is also preferable because of the superior vibration absorption property thereof.

The viscoelastic part and the mass-adding part may be set in a die, with the viscoelastic part and the mass-adding part laminated on each other to form them into a desired configuration. Alternatively the viscoelastic part and the mass-adding part may be formed into a flat sheet and the sheet is formed into a desired configuration by punching the sheet with a punching blade.

According to another aspect of the present invention, a tennis racket having a dynamic damper is installed on at least one portion of a gut-stretched part surrounding a face of a racket frame or/and at least one portion of a throat part of the tennis racket. The dynamic damper has a viscoelastic part and a mass-adding part integrally laminated on each other and is installed on at least one surface of the racket frame in a thickness direction thereof and both surfaces of the racket frame in a widthwise direction thereof. The dynamic damper installed on the racket frame allows for an out-of-plane 2nd damping factor of the racket frame and an in-plane 3rd damping factor thereof to be not less than 1%.

The out-of-plane 2nd damping factor and the in-plane 3rd damping correspond to the damping factor of an out-of-plane 2nd frequency and an in-plane 3rd frequency at the time when the tennis racket deforms in an out-of-plane 2nd mode and an in-plane 3rd mode, respectively. In the case where the value of the vibration damping factor is high (higher than 1%), the dynamic damper favorably damps vibrations generated when the tennis racket hits a ball. Thus a player does not feel uncomfortable vibrations. The dynamic damper has the one part resonating with the vibration of the racket frame in the out-of-plane direction and the other part resonating with the vibration thereof in the in-plane direction. Thus the dynamic damper installed on the tennis racket effectively reduces the vibration in the out-of-plane direction and the in-plane direction and relieves and reduces shock and vibrations sufficiently.

The dynamic damper has the viscoelastic part and the mass-adding part laminated on the viscoelastic part. The dynamic damper is installed on the racket frame via the viscoelastic part. Therefore, the viscoelastic part of the dynamic damper vibrates greatly for the vibration of the tennis racket, thus vibrating the mass-adding part. The dynamic damper vibrates earlier than the racket frame, thus consuming vibration energy of the racket frame and damping the vibration of the racket frame rapidly. Consequently, the dynamic damper can greatly reduce the degree of shock and vibrations to be applied to a player's hand.

In the dynamic damper, supposing that the top position of the face of the racket frame is 12 o'clock by regarding the face surrounded with the gut-stretched part as the surface of a clock, it is preferable to install the dynamic damper on at least one portion of an angular range of ±15° with respect to a three o'clock position and on at least one portion of an angular range of ±15° with respect to a nine o'clock position. The dynamic damper-installed tennis racket does not affect its operability and can reduce the vibration in the out-of-plane direction and the in-plane direction efficiently.

As described above, the vertical frame of the dynamic damper of the present invention mainly resonates with the vibration in the out-of-plane direction, while the horizontal frame thereof resonates with the vibration in the in-plane direction. Thus the dynamic damper can effectively reduce the vibration in both directions and relieves and reduces shock and vibrations sufficiently. The dynamic damper-installed tennis racket has the out-of-plane the 2nd damping factor and the in-plane the 3rd damping factor (hereinafter may be referred to as merely damping factor) at not less than 1% and is superior in its vibration-damping performance. Further because the weight of the entire dynamic damper is suitable for the tennis racket, a player can swing it favorably.

The three o'clock position and the nine o'clock position are maximum amplitude positions of the in-plane vibration and that of the out-of-plane the 2nd vibration. Thus the installation of the dynamic damper at the three o'clock position and the nine o'clock position is optimum for suppressing vibrations in the in-plane and out-of-plane directions and rotation of the grip.

Because a mass is applied to a portion of the gut-stretched part having a large width, the moment of inertia on the grip becomes large. Thus when we hit a ball at the off-center, the dynamic damper prevents the rotation of the racket and reduces the degree of burden to be applied to the player's elbow owing to the installation of the dynamic damper at the three o'clock position and the nine o'clock position.

As described above, it is preferable that the dynamic damper is installed on the gut-stretched part of the racket frame, with the longitudinal direction of the vertical frame set along the longitudinal direction (direction horizontal to the gut plain of the racket frame) of the racket frame.

In the dynamic damper, supposing that the top position of the face of the racket frame is 12 o'clock by regarding the face surrounded with the gut-stretched part as the surface of a clock, it is preferable to install the dynamic damper on at least one portion of an angular range of ±15° with respect to a four o'clock position and on at least one portion of an angular range of ±15° with respect to an eight o'clock position. The dynamic damper-installed tennis racket does not affect its operability and can reduce the vibration of the racket frame in the out-of-plane direction and the in-plane direction efficiently. More specifically, because the balance of the tennis racket can be placed at the side of the player's hand, the player can swing the tennis racket easily.

In the dynamic damper, supposing that the top position of the face of the racket frame is 12 o'clock by regarding the face surrounded with the gut-stretched part as the surface of a clock, it is preferable to install the dynamic damper on at least one portion of an angular range of ±15° with respect to a five o'clock position and on at least one portion of an angular range of ±15° with respect to a seven o'clock position. The dynamic damper-installed tennis racket does not hurt its operability and can reduce the vibration of the racket frame in the out-of-plane direction and the in-plane direction efficiently. More specifically, because the balance of the tennis racket can be placed at the side of the player's hand, the player can swing the tennis racket easily.

From the viewpoint of balance, it is preferable that the dynamic damper of the present invention is installed on the racket frame at left and right positions symmetrical with respect to the center in the widthwise direction of the racket frame. But the dynamic damper-installing position is not limited to a symmetrical position. A plurality of the dynamic dampers maybe mounted on the racket frame.

It is preferable to make a concavity of the racket on the dynamic damper-installing position.

DETAILED DESCRIPTION OF THE PREFERRED EMBODIMENTS

The embodiments of the present invention will be described below with reference to drawings.

Figure 1:
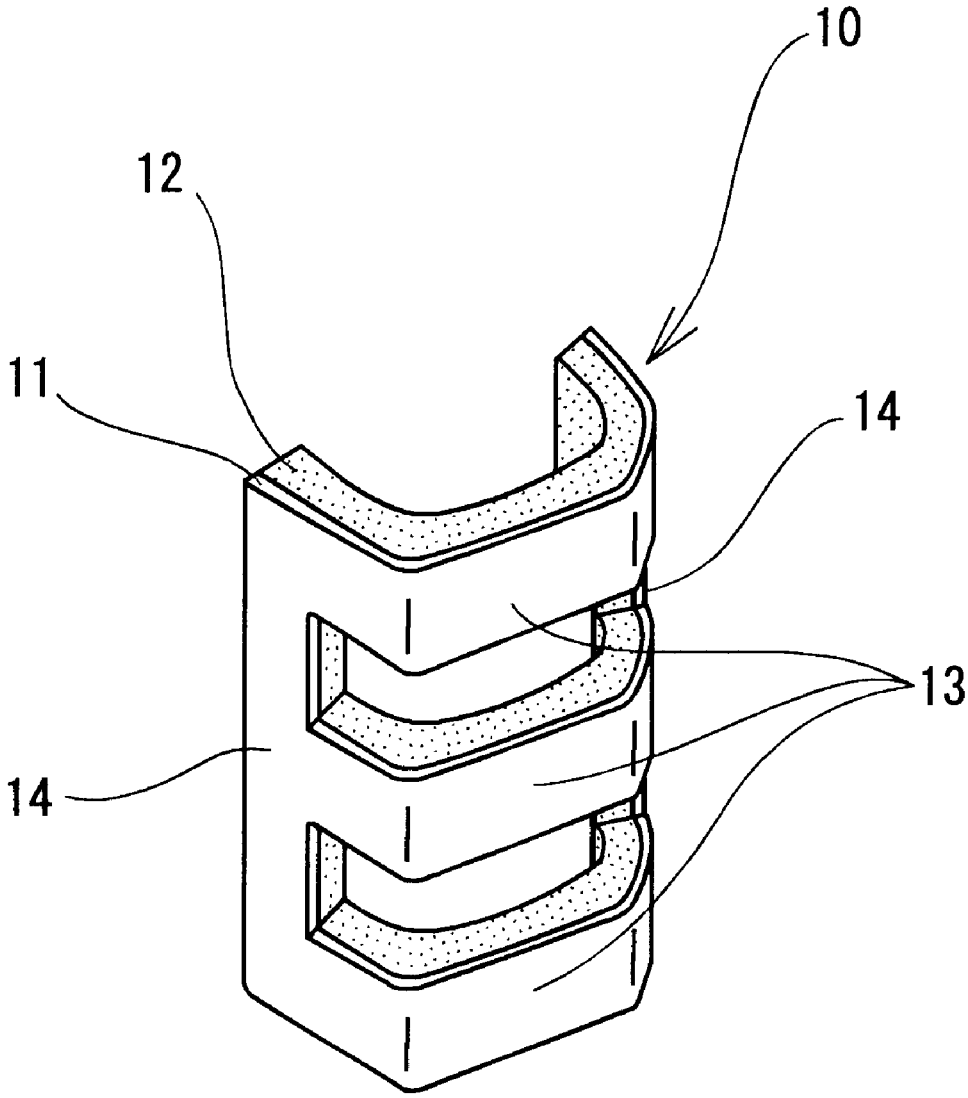
FIG. 1 is a perspective view showing a dynamic damper of an embodiment of the present invention.
Figure 2:
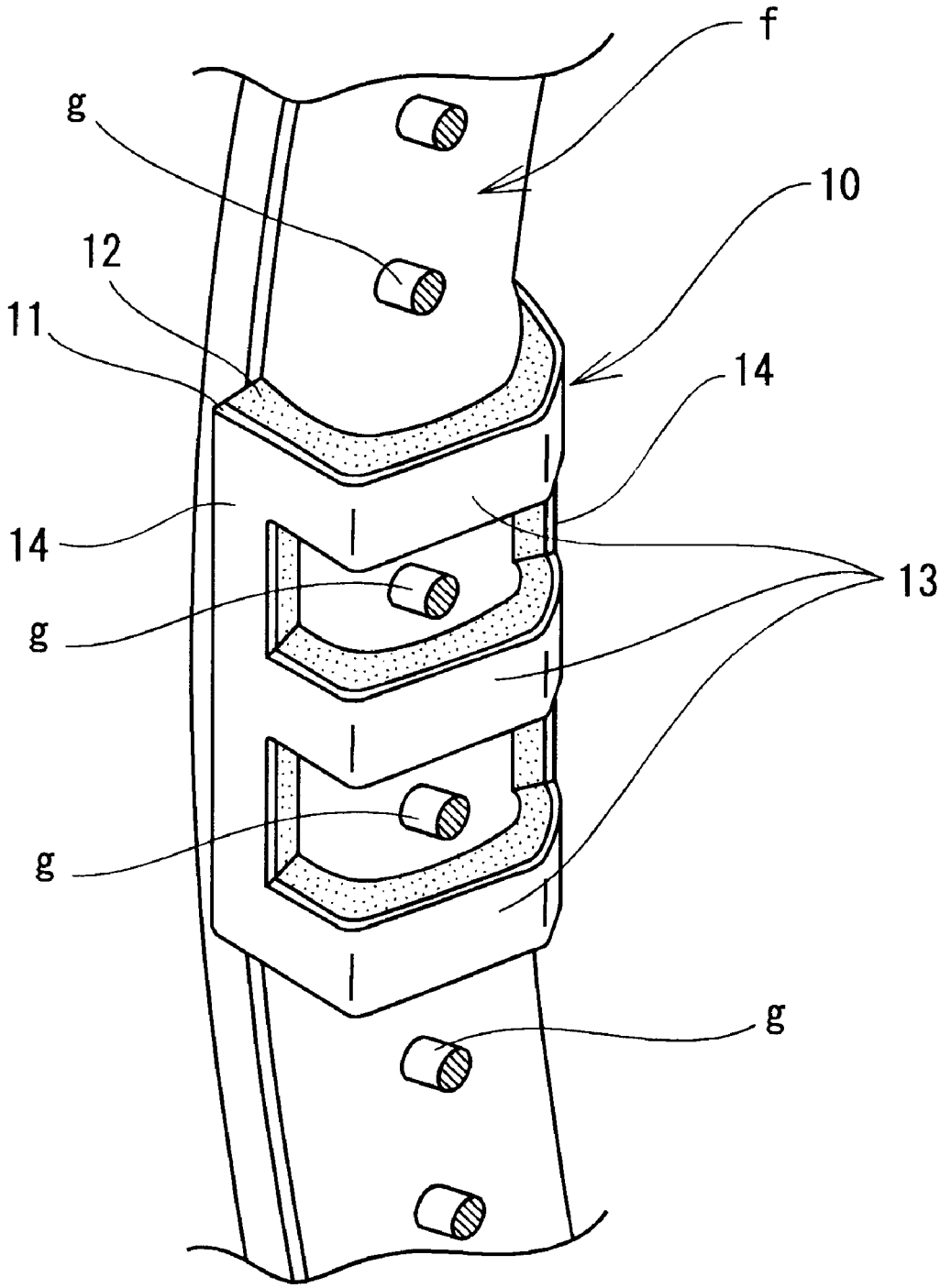
FIG. 2 is a perspective view showing a state in which the dynamic damper of the embodiment of the present invention has been installed on a racket frame.

FIGS. 1 through 3 show a dynamic damper 10 of a first embodiment of the present invention.

The dynamic damper 10 is installed on a tennis racket. As shown in FIG. 1, the dynamic damper 10 is composed of a sheet consisting of a mass-adding part 11 and a viscoelastic part 12 layered on the mass-adding part 11. The sheet is bent in the shape of "U" in section to dispose three horizontal frames 13 almost parallel to one another at certain intervals. Two vertical frames 14, consisting of the sheet, parallel to each other are positioned at both ends of the horizontal frames 13. Both parts are continuous and integral with each other to make the dynamic damper 10 lattice-shaped.

Figure 3A:
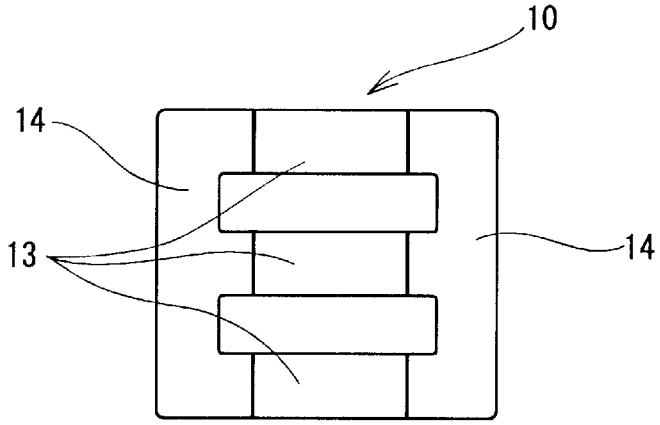
FIG. 3A is a front view showing the dynamic damper of the embodiment of the present invention.
Figure 3B:
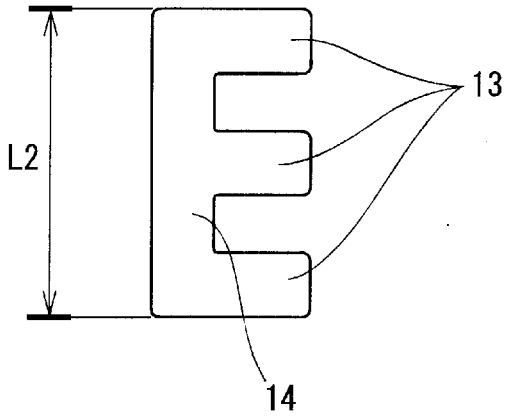
FIG. 3B is a side view showing the dynamic damper of the embodiment of the present invention.
Figure 3C:
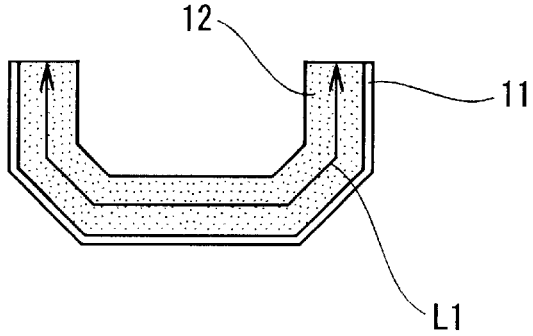
FIG. 3C is a plan view showing the dynamic damper of the embodiment of the present invention.

As shown in FIGS. 3A, 32, and 3C, the ratio of the length L2 (the length horizontal or parallel to the gut plane of the racket when the dynamic damper 10 is installed thereon) of the vertical frame 14 to the length L1 (the length perpendicular to the gut plain of the racket when the dynamic damper 10 is installed thereon) of the horizontal frame 13 is not less than 0.3 nor more than 1.0.

The width of each portion of the viscoelastic part 12 is not less than 4 mm nor more than 8 mm. The thickness of each portion of the viscoelastic part 12 is not less than 2.5 mm nor more than 5.5 mm.

The total weight of the dynamic damper 10 is not less than 8 g nor more than 23 g.

The mass-adding portion 11 consists of a mixture of metal powder having a high specific gravity serving as a main component and the thermoplastic elastomer or a thermoplastic resin also serving as the main component. In the mixture, the metal powder is dispersed in the thermoplastic elastomer or the thermoplastic resin. The complex modulus of elasticity of the mass-adding part 11 at 20° C. and 10 Hz is not less than 100 MPa nor more than 800 MPa. The complex modulus of elasticity of the viscoelastic part 12 at 20° C. and 10 Hz is not less than 0.5 MPa nor more than 1.5 MPa.

As shown in FIG. 2, the dynamic damper 10 is installed on a racket frame f, with the central portion of the U-shaped horizontal frame 13 disposed on the inner surface of the racket frame f in its thickness direction, the bent portion at both sides of the horizontal frame 13 disposed on both surfaces of the racket frame f in its widthwise direction, the long and narrow vertical frame 14 disposed on both surfaces of the racket frame f in its widthwise direction, and the surface of the dynamic damper 10 at the side of the viscoelastic part 12 in contact with the inner side (gut-stretched side) of the racket frame f. The three horizontal frames 13 parallel with one another are installed on the racket frame, with the horizontal frames 13 sandwiching gut insertion holes g therebetween.

Figure 4:
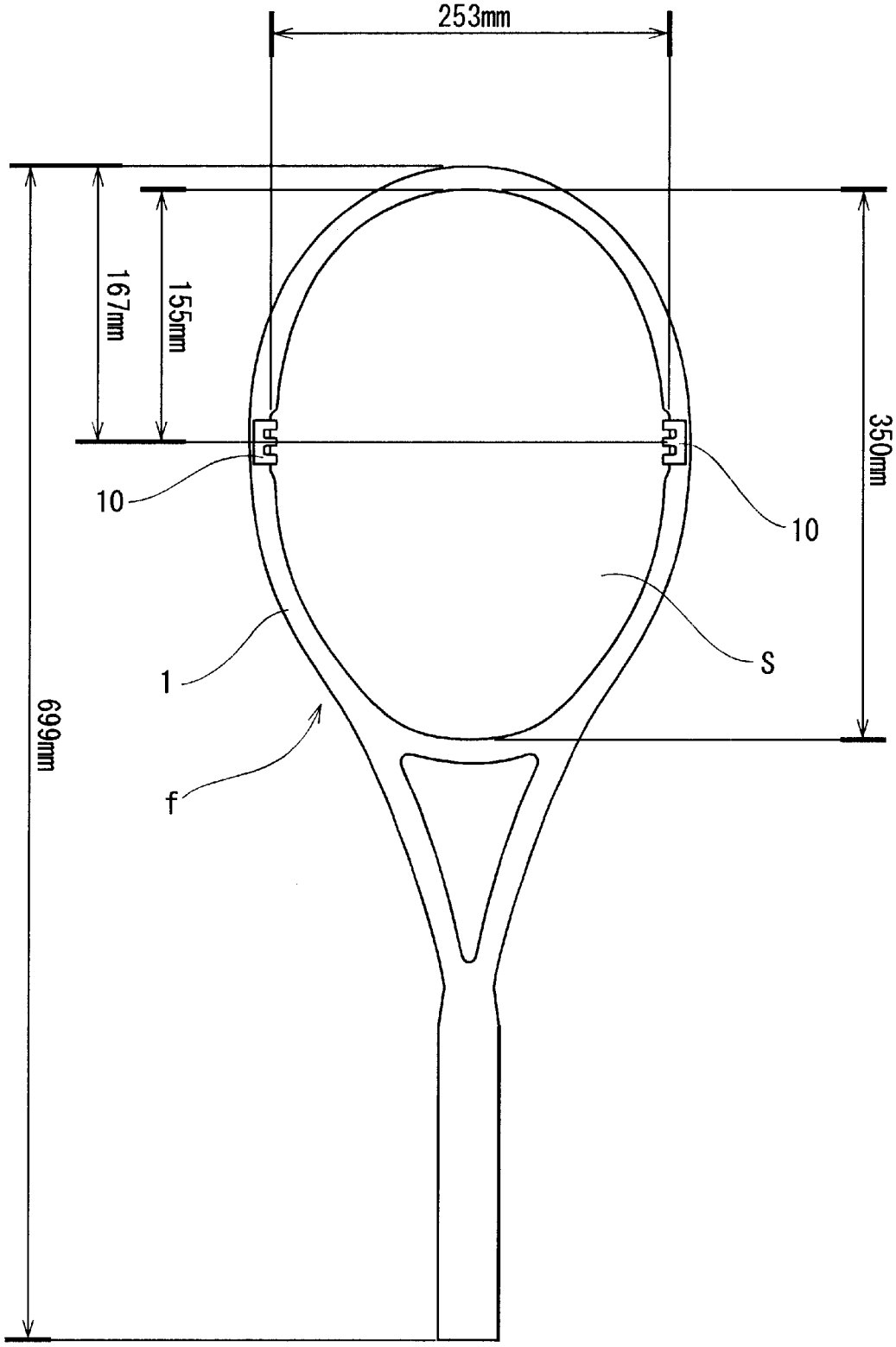
FIG. 4 is a plan view showing a state in which the dynamic damper of the embodiment of the present invention is installed at three and nine o'clock positions of the racket frame.

As shown in FIG. 4, with an adhesive agent, the dynamic damper 10 is fixed to each of a three o'clock position and a nine o'clock position of a gut-stretched part 1 surrounding the face S of the racket frame f. Because the dynamic damper 10 is installed on the face s in the above-described manner, the racket frame has an out-of-plane 2nd damping factor and an in-plane 3rd damping factor of not less than 1%.

In the dynamic damper 10 of the first embodiment, the sectionally U-shaped three horizontal frames 13 and the two long and narrow vertical frames 14 are integral with each other and perpendicular to each other in such a way that the horizontal frames 13 and the vertical frames 14 are disposed in the shape of a lattice. Thereby the dynamic damper 10 can relieve and reduce shock and vibrations sufficiently in the in-plane direction as well as in the out-of-plane direction.

The dynamic damper of the present invention can be produced as follows:

Initially, the metal powder having a high specific gravity and the thermoplastic elastomer are sufficiently mixed at a suitable mixing ratio by using a mill. Thereafter, the mixture is pressed and heated to shape it into a sheet. Thereafter, the sheet is cut to a necessary size to obtain a mixture piece for the mass-adding part. Then the obtained mixture piece is set in a die for molding it into the dynamic damper having a desired configuration. A pellet of the thermoplastic elastomer for the viscoelastic part is set in the die to press the mixture piece and the pellet at a certain temperature to obtain the dynamic damper.

Instead, it is possible to pulverize the material mixed by using the mill and set it into a cavity of a die for the mass-adding part. The material is shaped by press molding at a certain temperature to obtain the mass-adding part. Then the mass-adding part is set in the die for the dynamic damper.

As described above, the dynamic damper is installed on the racket frame in such a way that the long and narrow vertical frame is parallel with the longitudinal direction of the racket frame. Thereby the dynamic damper contributes to relieve and reduction of shock and vibrations in the in-plane direction and the out-of-plane direction.

Figure 5:
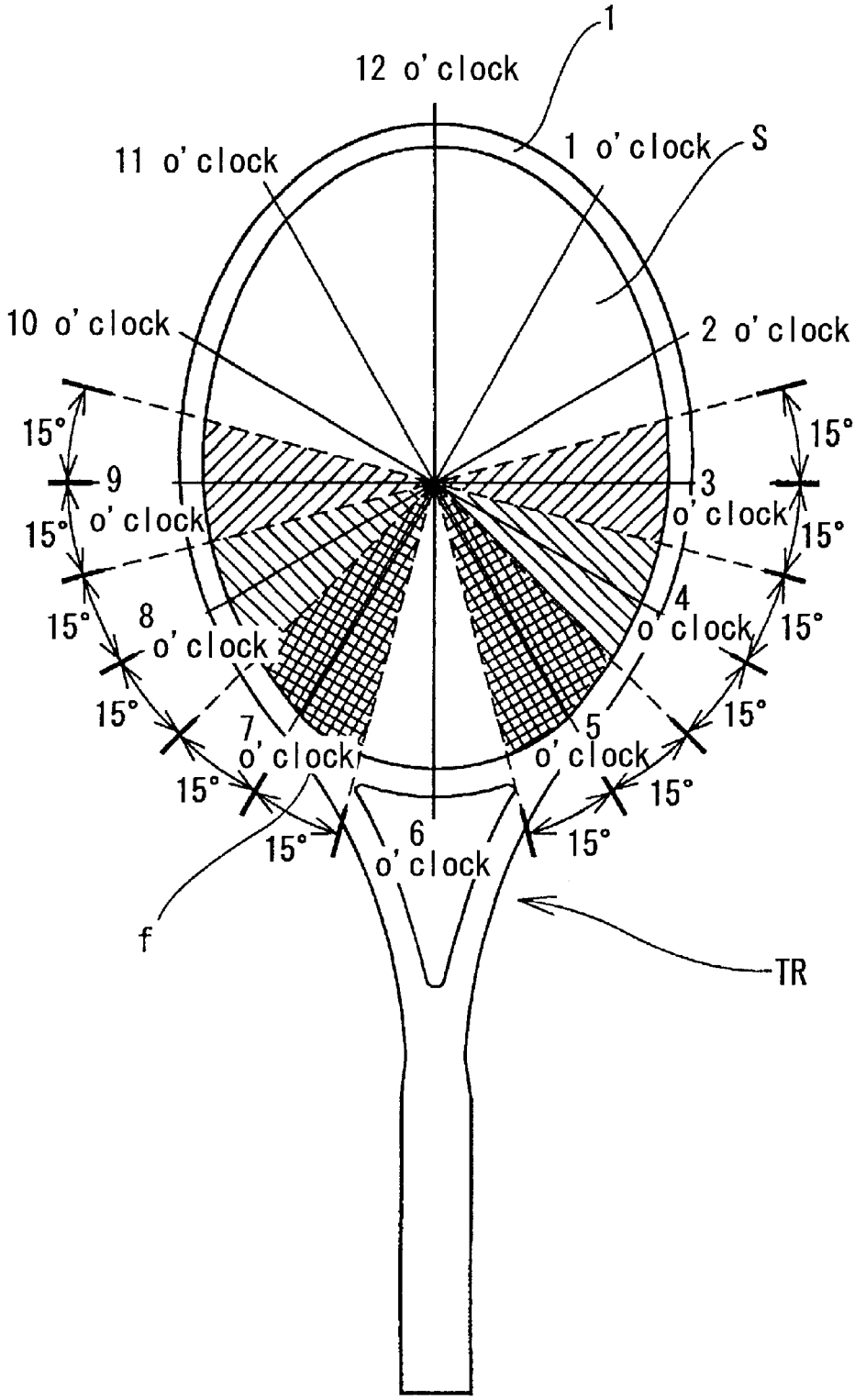
FIG. 5 is a plan view showing positions of the dynamic damper of the embodiment of the present invention on the racket frame.

In the first embodiment, the dynamic damper is installed on three and nine o'clock positions of the racket frame. Instead, as shown in FIG. 5, the dynamic damper may be installed on the following positions to allow a tennis racket TR to have superior vibration-damping performance: Supposing that the top position of the face S of the racket frame is 12 o'clock by regarding the face S surrounded with the gut-stretched part 1 as the surface of a clock, the dynamic damper is installed on at least one portion of an angular range of ±15° with respect to the three o'clock position and on at least one portion of an angular range of ±15° with respect to the nine o'clock position, on at least one portion of an angular range of ±15° with respect to the four o'clock position and on at least one portion of an angular range of ±15° with respect to the eight o'clock position, and on at least one portion of an angular range of ±15° with respect to the five o'clock position and on at least one portion of an angular range of ±15° with respect to the seven o'clock position.

Figure 6:
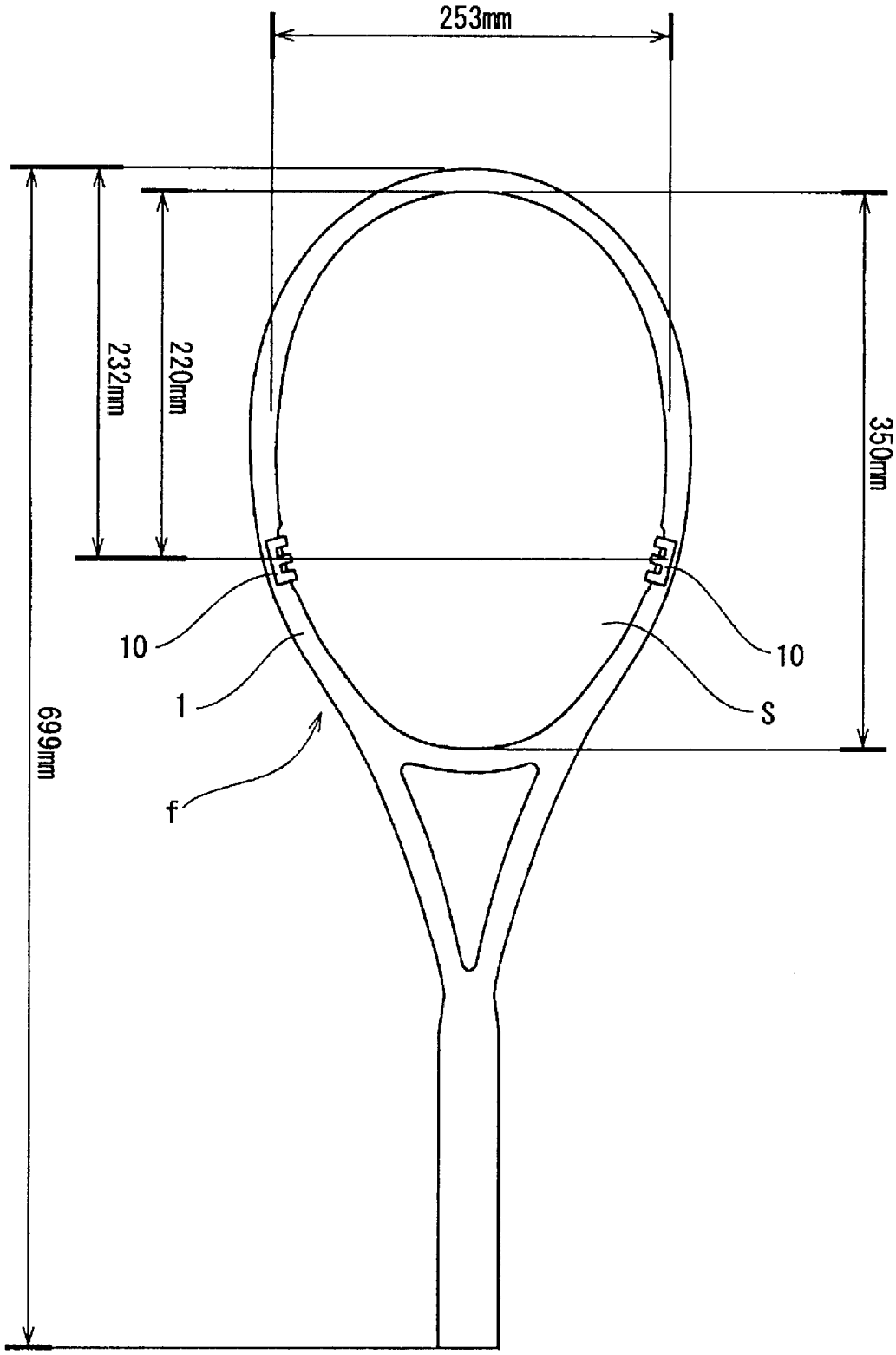
FIG. 6 is a plan view showing a state in which the dynamic damper of the embodiment of the present invention is installed at four and eight o'clock positions of the racket frame.
Figure 7:
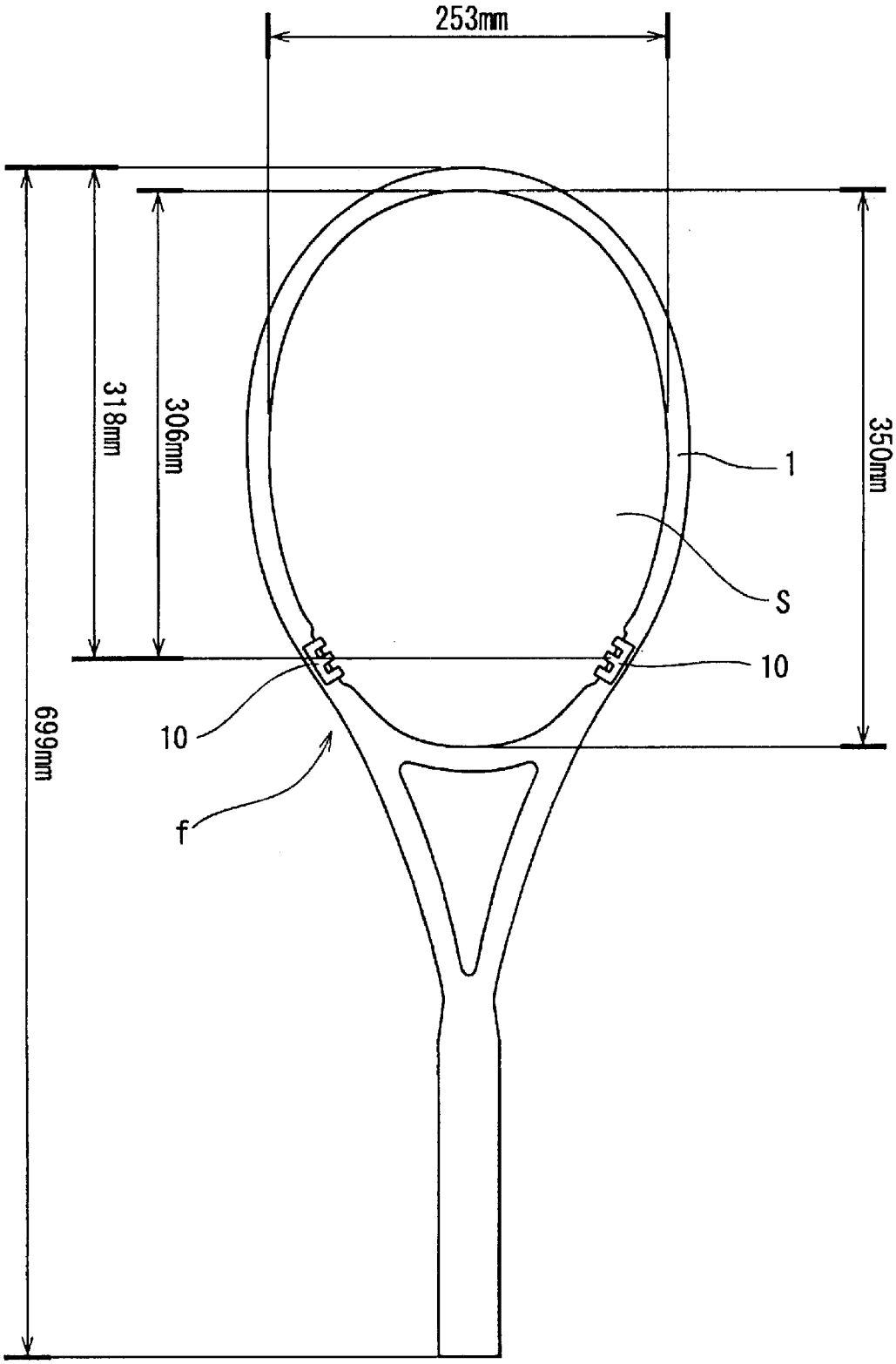
FIG. 7 is a plan view showing a state in which the dynamic damper of the embodiment of the present invention is installed at five and seven o'clock positions of the racket frame.

More specifically, supposing that the top position of the face S of the racket frame is 12 o'clock by regarding the face S surrounded with the gut-stretched part 1 as the surface of a clock, as shown in FIG. 6, the dynamic damper 10 may be installed at the four and nine o'clock positions. Alternatively as shown in FIG. 7, the dynamic damper 10 may be installed at the five and seven o'clock positions.

The dynamic damper may be applied to racket frames made of materials other than fiber-reinforced resin or metal.

Tennis rackets of examples 1–7 and comparison examples 1–3 on which the dynamic damper of the present invention was installed will be described below.

The configurations of the tennis rackets, the lengths thereof, and the face areas of the examples and the comparison examples are equal to each other. The entire length of the tennis racket was set to 699 mm. The thickness of the gut-stretched part surrounding the face S was set to 24 mm. The thickness of the throat part was 21 mm. The width of the gut-stretched part was 12 mm. The width of the throat part was 14 mm. The thickness and width of the portion of the racket frame on which the dynamic damper was installed were 21 mm and 12 mm respectively. The thickness and width of the portion of the racket frame disposed at both sides of the dynamic damper-installed portion were 24 mm and 14.5 mm respectively both of which were a little thicker than the dynamic damper-installed portion. Th weight of the tennis racket having no guts stretched on the face S was 260 g. The balance point was spaced 335 mm from the grip end. The racket frame was made of the fiber-reinforced resin and hollow. Epoxy resin was used as the matrix resin. Carbon fiber was used as the reinforcing fiber.

The dynamic damper was installed on the racket frame in such a way that the longitudinal direction of the vertical frame thereof was parallel to the longitudinal direction of the racket frame.

EXAMPLE 1

The heavy metal sheet serving as the mass-adding part 11 of a dynamic damper 10*a* was produced by Sumitomo Electric Industry Corp. The heavy metal sheet had a thickness of 0.6 mm, a specific gravity of nine, and a complex modulus of elasticity of 200 MPa. The heavy metal sheet was tungsten-powder containing chloroprene rubber.

As the viscoelastic part 12 of the dynamic damper 10*a*, rubber having the composition shown in table 1 was used. The viscoelastic part 12 had a complex modulus of elasticity of 0.53 MPa.

TABLE 1

| Component | Parts by weight |
|---|---|
| Esprene 532 (EPDM) (Sumitomo Chemical Industry) | 100 |

TABLE 1-continued

| Component | Parts by weight |
|---|---|
| Diana process oil Px-90(Idemitsu Kosan) | 200 |
| Zinc white | 150 |
| Stearic acid | 5 |
| Sulfur | 1 |
| Vulcanization accelerator M | 1.0 |
| Vulcanization accelerator TET | 0.5 |
| Vulcanization accelerator BZ | 0.5 |
| Vulcanization accelerator TTTE | 0.5 |
| Titanium oxide | 10 |

Where M is 2-melcaptobenzothiazole, TET is tetraethylthiuram disulfide, BZ is zinc di-n-butyl dithioalbumate, and TTTE denotes tellurium diethyl dithioearbamate.

Figure 8A:
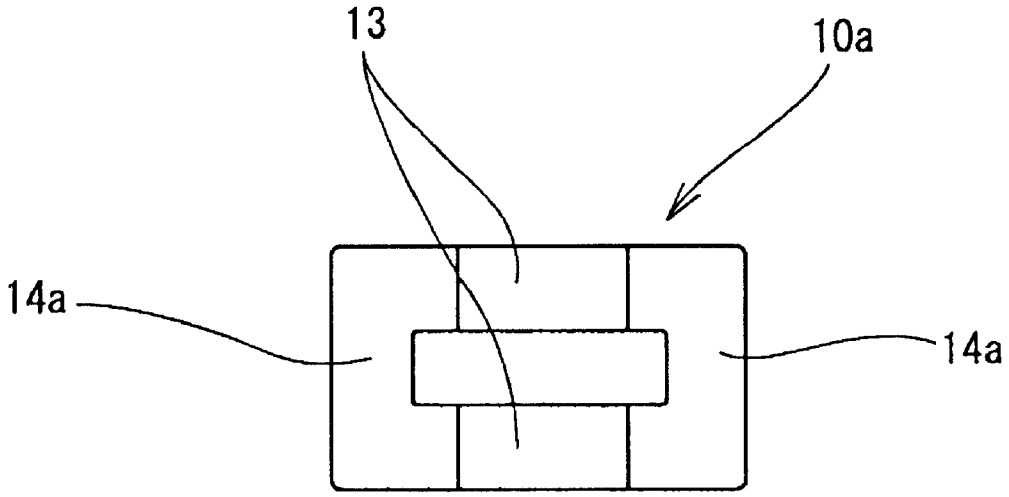
FIG. 8A is a front view showing a dynamic damper of an example 1.
Figure 8B:
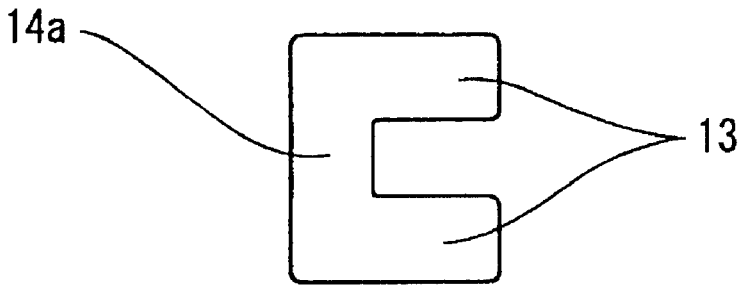
FIG. 8B is a side view showing the dynamic damper of the example 1.

The mass-adding part 11 and the viscoelastic part 12 were set in a die, with the mass-adding part 11 and the viscoelastic part 12 layered on each other to perform press molding and vulcanization at 170° C. for 20 minutes. The obtained dynamic damper 10*a* had a thickness of 4 mm, a width of 5 mm, and a length-to-breadth ratio of 0.38. As shown in FIGS. 8A and 8B, two U-shaped horizontal frames 13 and two long and narrow vertical frames 14*a* were integral with each other to form the dynamic damper in the shape of a lattice. The interval between the adjacent U-shaped horizontal frames 13 was 5.5 mm. The length of the long and narrow vertical frame 14*a* was 15.5 mm. The length of the U-shaped horizontal frame 13 was 41 mm. The dynamic damper 10*a* was fixed to the three and nine o'clock positions of the gut-stretched part of the racket frame with an adhesive agent.

EXAMPLE 2

The material for the mass-adding part 11 and the viscoelastic part 12 and the method of producing the dynamic damper are the same as those of the example 1. But the length-to-breadth ratio was 0.64. The dynamic damper of the example 2 had the same configuration as that of the dynamic damper of the example 1. As shown in FIGS. 3A, 3B, and 3C, three U-shaped horizontal frames 13 were formed integrally with two long and narrow vertical frames 14 to form the dynamic damper in the shape of a lattice. The interval between the adjacent U-shaped horizontal frames 13 was 5.5 mm. The length of the long and narrow vertical frame 14 was 26 mm. The length of the U-shaped horizontal frame 13 was 41 mm. The dynamic damper 10*a* was fixed to the three and nine o'clock positions of the gut-stretched part of the racket frame with an adhesive agent.

EXAMPLE 3

Figure 9A:
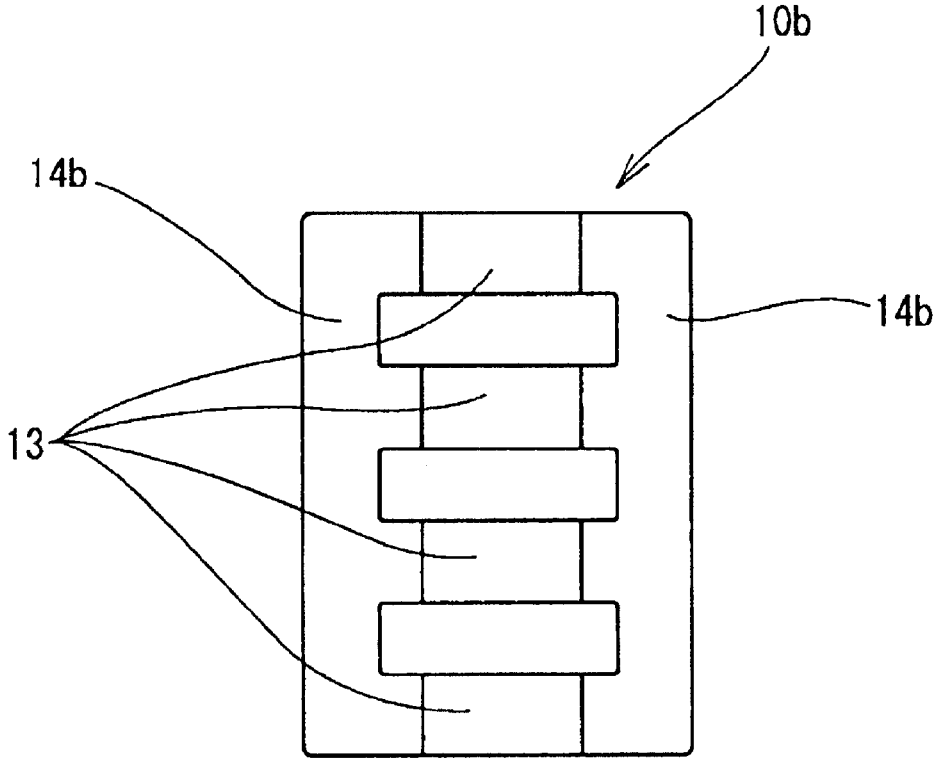
FIG. 9A is a front view showing a dynamic damper of an example 3.
Figure 9B:
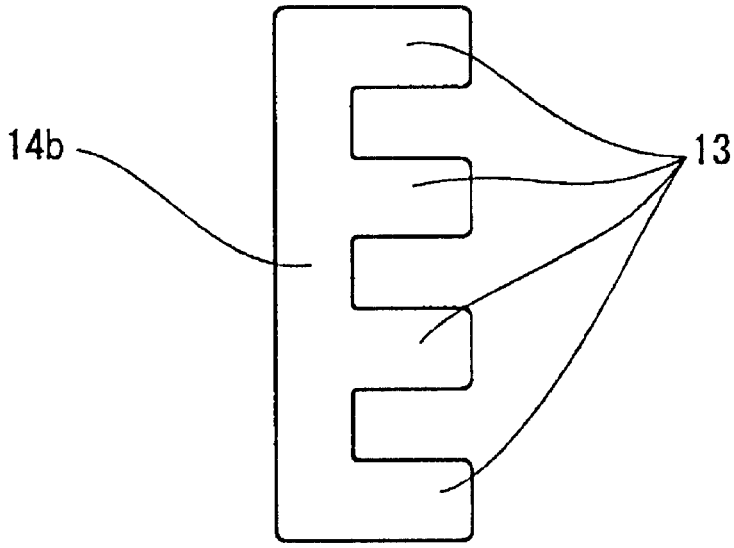
FIG. 9B is a side view showing the dynamic damper of the example 3.

The material of the mass-adding part 11 and the viscoelastic part 12 and the method of producing the dynamic damper were the same as those of the example 1. The length-to-breadth ratio was 0.9. As shown in FIGS. 9A, 9B, four U-shaped horizontal frames 13 were formed integrally with two long and narrow vertical frames 14*b* to form the dynamic damper in the shape of a lattice. The interval between the adjacent U-shaped horizontal frames 13 was 5.5 mm. The length of the long and narrow vertical frame 14*b* was 36.5 mm. The length of the U-shaped horizontal frame 13 was 41 mm. The dynamic damper 10*b* was fixed to the three and nine o'clock positions of the gut-stretched part of the racket frame with an adhesive agent.

EXAMPLE 4

The dynamic damper 10 of the example 2 was fixed to the five and seven o'clock positions of the gut-stretched part 1 of the racket frame with an adhesive agent.

EXAMPLE 5

Figure 10A:
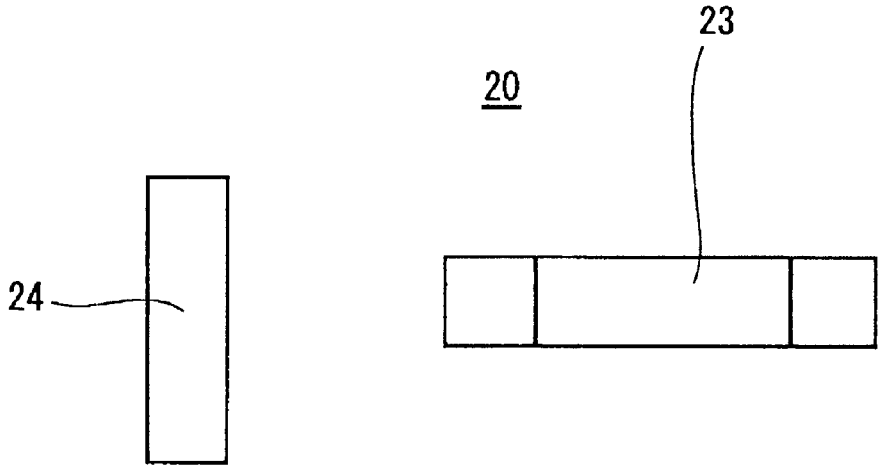
FIGS. 10A and 10B are a schematic view respectively showing a dynamic damper of an example 5.
Figure 10B:
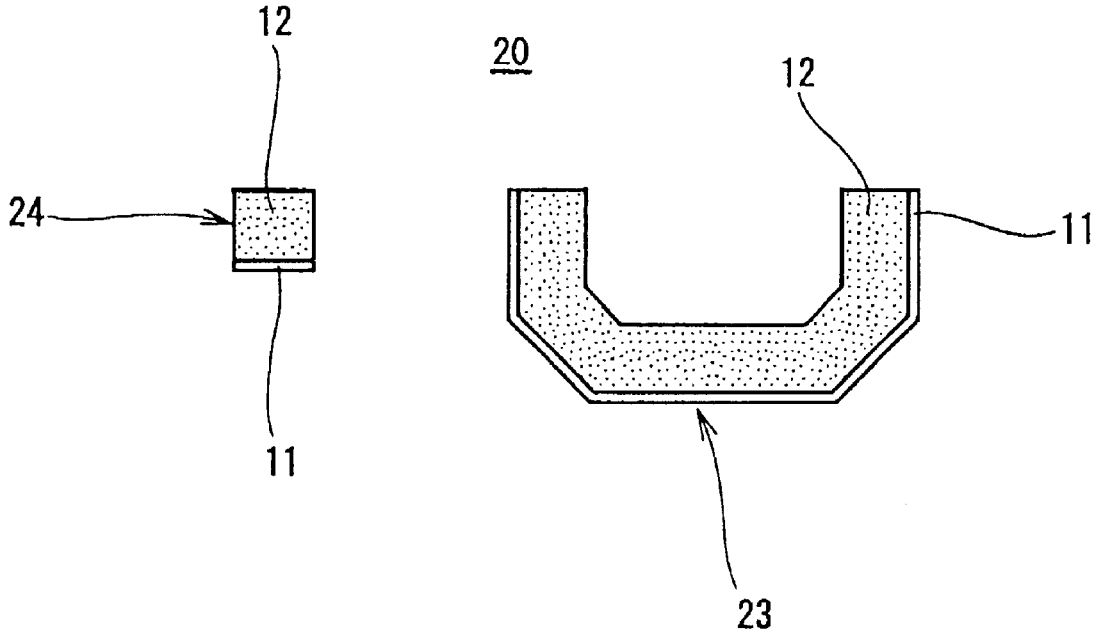

The material of the mass-adding part 11 and the viscoelastic part 12 and the method of producing the dynamic damper were the same as those of the example 1. However as shown in FIGS. 10A and 10B, two U-shaped horizontal frames 23 and two vertical frames 24 of a dynamic damper 20 were disposed separately in the shape of a lattice.

Figure 11A:
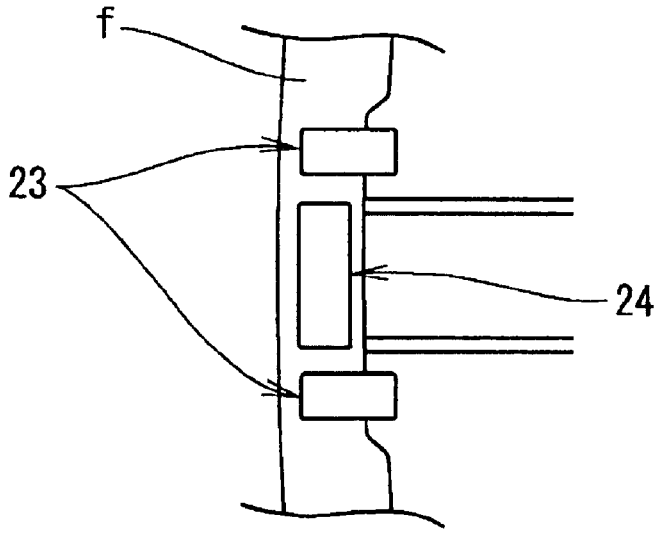
FIG. 11A is a schematic front view showing a state in which a dynamic damper of the example 5 is installed on a racket frame.
Figure 11B:
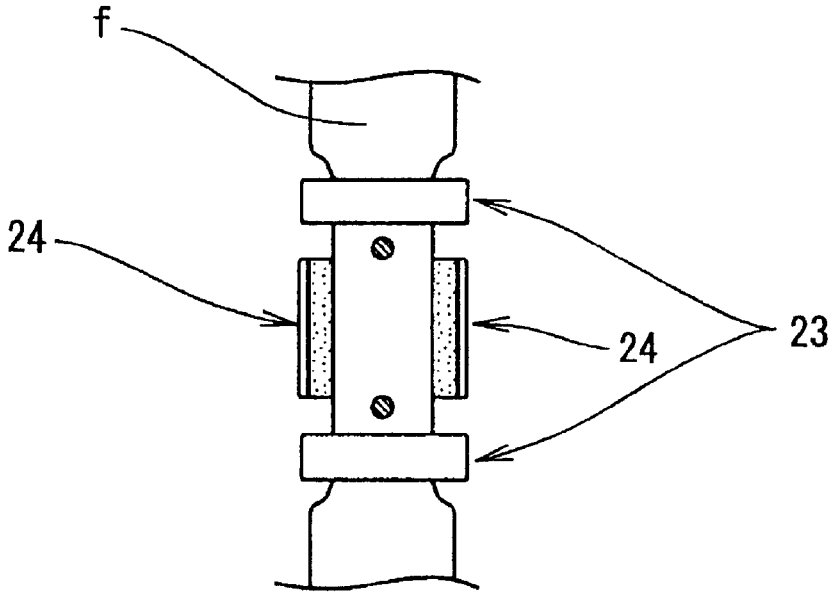
FIG. 11B shows the dynamic damper of the example 5 installed on the racket frame from the inside.

The length of the long and narrow vertical frame 24 was 15 mm. The length of the U-shaped horizontal frame 23 was 41 mm. As shown in FIGS. 11A and 11B, the dynamic damper 20 was fixed to the three and nine o'clock positions of the gut-stretched part of the racket frame with an adhesive agent.

EXAMPLE 6

The material of the mass-adding part 11 and the viscoelastic part 12 and the method of producing the dynamic damper were the same as those of the example 1. However heavy metal sheet having a thickness of 1.0 mm was used in addition to the heavy metal sheet having a thickness of 0.6 mm equal to the thickness of the heavy metal sheet of the example 1. In the case where the heavy metal sheet having the thickness of 1.0 mm was used, the thickness of the viscoelastic part was set to 3.5 mm, the entire thickness of the dynamic damper was set to 4 mm, and 200 parts by weight of oil was added to rubber of the viscoelastic part.

Figure 12A:
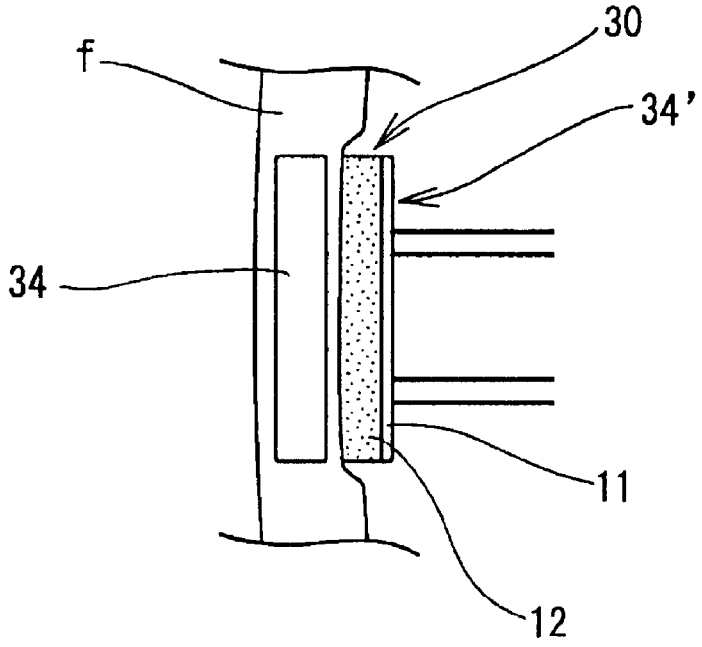
FIG. 12A is a schematic front view showing a state in which a dynamic damper of an example 6 is installed on a racket frame.
Figure 12B:
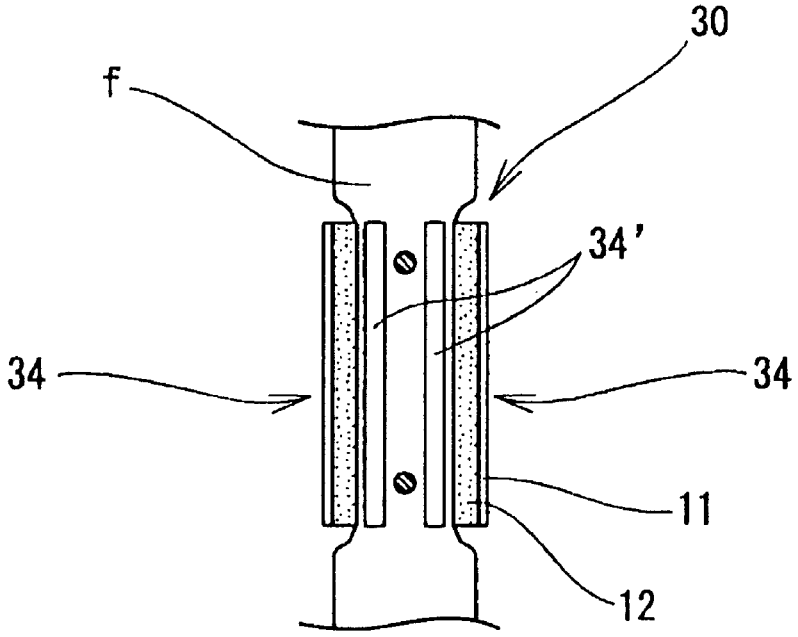
FIG. 12B shows the dynamic damper of the example 6 installed on the racket frame from the inside.

As shown in FIGS. 12A and 12B, two long and narrow vertical frames 34' each consisting of the heavy metal sheet having the thickness of 0.6 mm and two long and narrow vertical frames 34 each consisting of the heavy metal sheet having the thickness of 1.0 mm were fixed to the three and nine o'clock positions of the gut-stretched part of the racket frame with an adhesive agent to form a dynamic damper 30. The length of each of the vertical frames 34 and 34' was set to 26 mm.

EXAMPLE 7

Figure 13A:
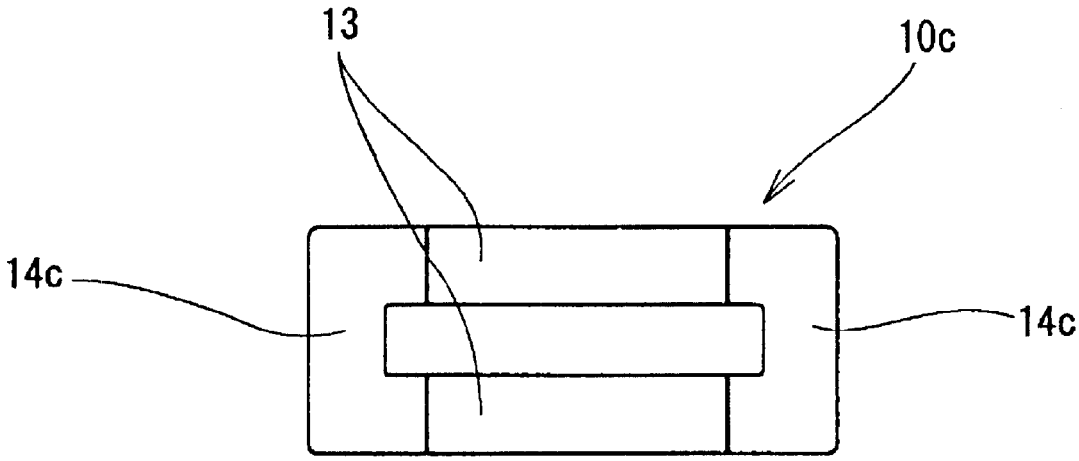
FIG. 13A is a front view showing a dynamic damper of an example 7.
Figure 13B:
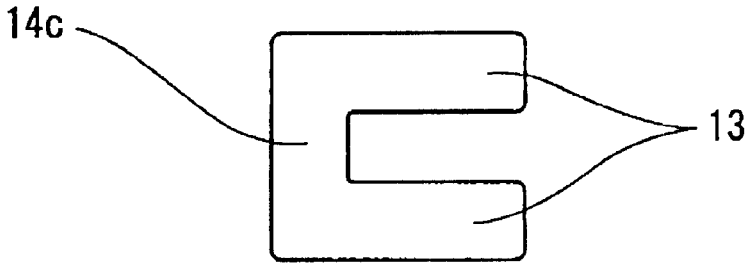
FIG. 13B is a side view showing the dynamic damper of the example 7.

The material of the mass-adding part 11 and the viscoelastic part 12 and the method of producing the dynamic damper were the same as those of the example 1. The length-to-breadth ratio was 0.29. As shown in FIGS. 13A and 13B, two U-shaped horizontal frames 13 were formed integrally with two vertical frames 14*c* to form the dynamic damper in the shape of a lattice. The interval between the adjacent U-shaped horizontal frames 13 was 2 mm. The length of the long and narrow vertical frame 14*c* was 12 mm. The length of the U-shaped horizontal frame 13 was 41 mm. The dynamic damper 10*c* was fixed to the three and nine o'clock positions of the gut-stretched part of the racket frame with an adhesive agent.

COMPARISON EXAMPLE 1

Figure 14A:
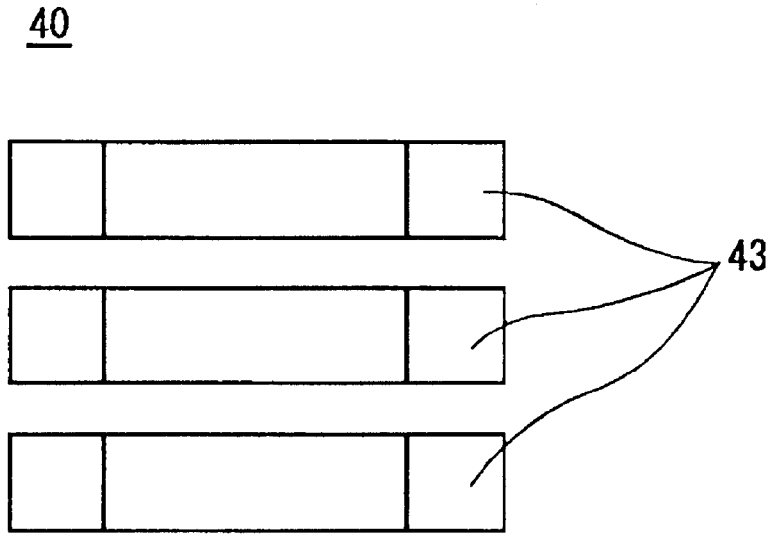
FIG. 14A is a front view showing a dynamic damper of a comparison example 1.
Figure 14B:
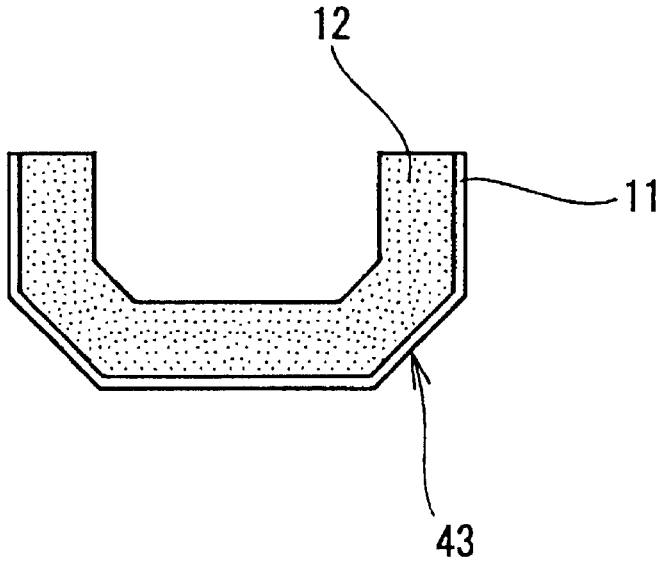
FIG. 14B is a plan view showing a dynamic damper of a comparison example 1.

The material of the mass-adding part 11 and the viscoelastic part 12 and the method of producing the dynamic damper were the same as those of the example 1. As shown in FIGS. 14A and 14B, a dynamic damper 40 consisting of three U-shaped parts 43 was fixed to the three and nine o'clock positions of the gut-stretched part of the racket frame with an adhesive agent in such a way that the longitudinal direction of the three U-shaped parts 43 were perpendicular to the longitudinal direction of the racket frame and that the three U-shaped parts 43 were almost parallel with each other, with the three U-shaped parts 43 spaced at certain intervals. Each of the three U-shaped parts 43 was disposed between adjacent gut insertion holes.

COMPARISON EXAMPLE 2

Figure 15A:
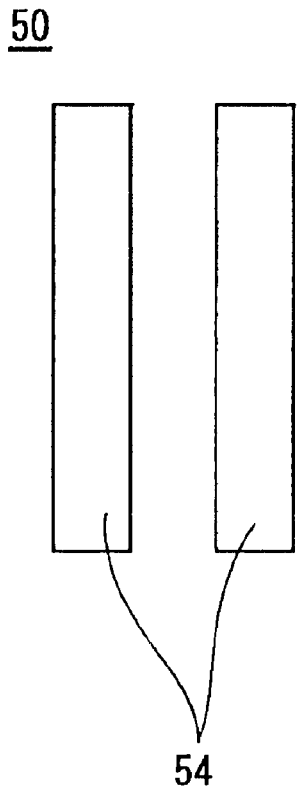
FIG. 15A is a front view showing a dynamic damper of a comparison example 2.
Figure 15B:
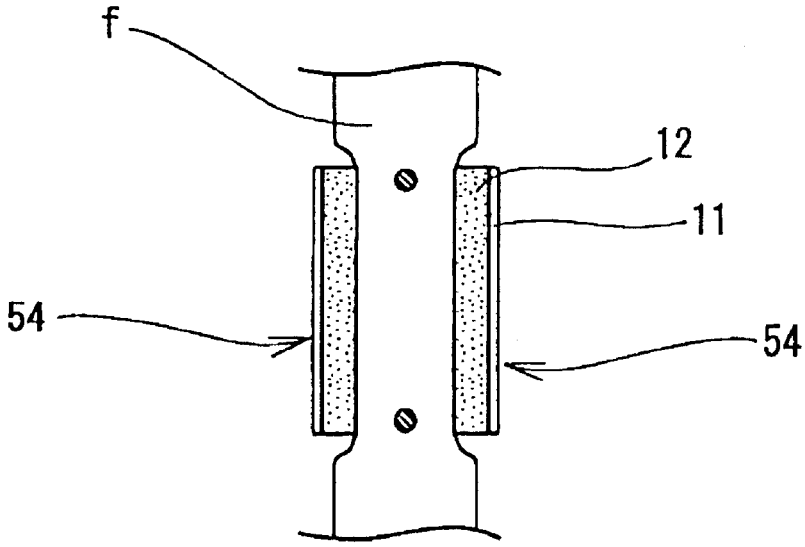
FIG. 15B is a front view showing a state in which the dynamic damper of the comparison example 2 has been installed on a racket frame.

The material of the mass-adding part 11 and the viscoelastic part 12 and the method of producing the dynamic damper were the same as those of the example 1. As shown in FIGS. 15A and 15B, a dynamic damper 50 consisting of two long and narrow parts 54 was fixed to the three and nine o'clock positions of the gut-stretched part of the racket frame with an adhesive agent in such a way that the longitudinal direction of the long and narrow parts 54 were parallel to the longitudinal direction of the racket frame with the long and narrow parts 54 disposed at both sides of the racket frame in its widthwise direction. The length of each of the long and narrow parts 54 was 26 mm.

COMPARISON EXAMPLE 3

Figure 16A:
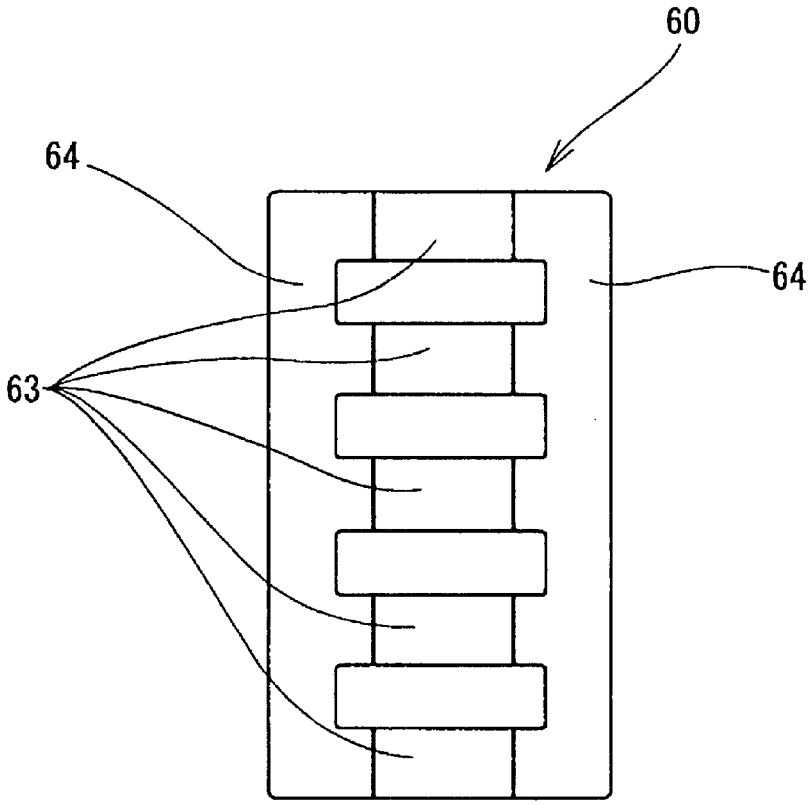
FIG. 16A is a front view showing a dynamic damper of a comparison example 3.
Figure 16B:
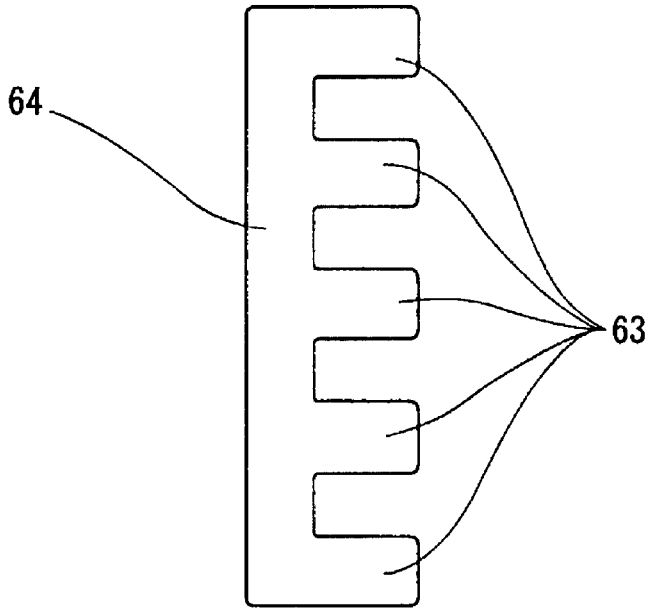
FIG. 16B is a side view showing a dynamic damper of the comparison example 3.

The material of the mass-adding part 11 and the viscoelastic part 12 and the method of producing the dynamic damper were the same as those of the example 1. The length-to-breadth ratio was 1.16. As shown in FIGS. 16A and 16B, five U-shaped horizontal frames 63 were formed integrally with two long and narrow vertical frames 64 to form the dynamic damper in the shape of a lattice. The interval between the adjacent U-shaped horizontal frames 63 was 5.5 mm. The length of the long and narrow vertical frame 64 was 47 mm. The length of the U-shaped horizontal frame 63 was 41 mm. The dynamic damper 10*b* was fixed to the three and nine o'clock positions of the gut-stretched part of the racket frame with an adhesive agent.

The out-of-plane the 2nd frequency, vibration suppression effect, out-of-plane the 2nd damping factor, and in-plane the 3rd damping factor of the tennis racket of the examples 1–7 and the comparison examples 1–3 were measured, and the vibrations thereof were evaluated.

Measurement of Frequency and Vibration-damping Ratio

Figure 17:
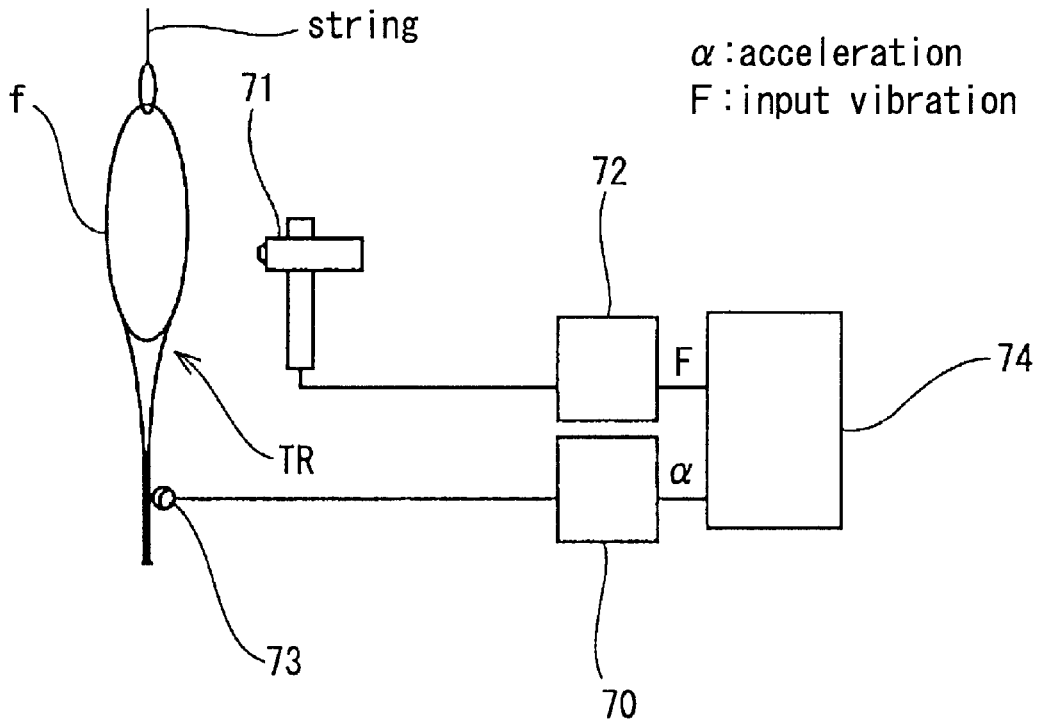
FIG. 17 is a block diagram showing a system for measuring a frequency and a damping factor.
Figure 18:
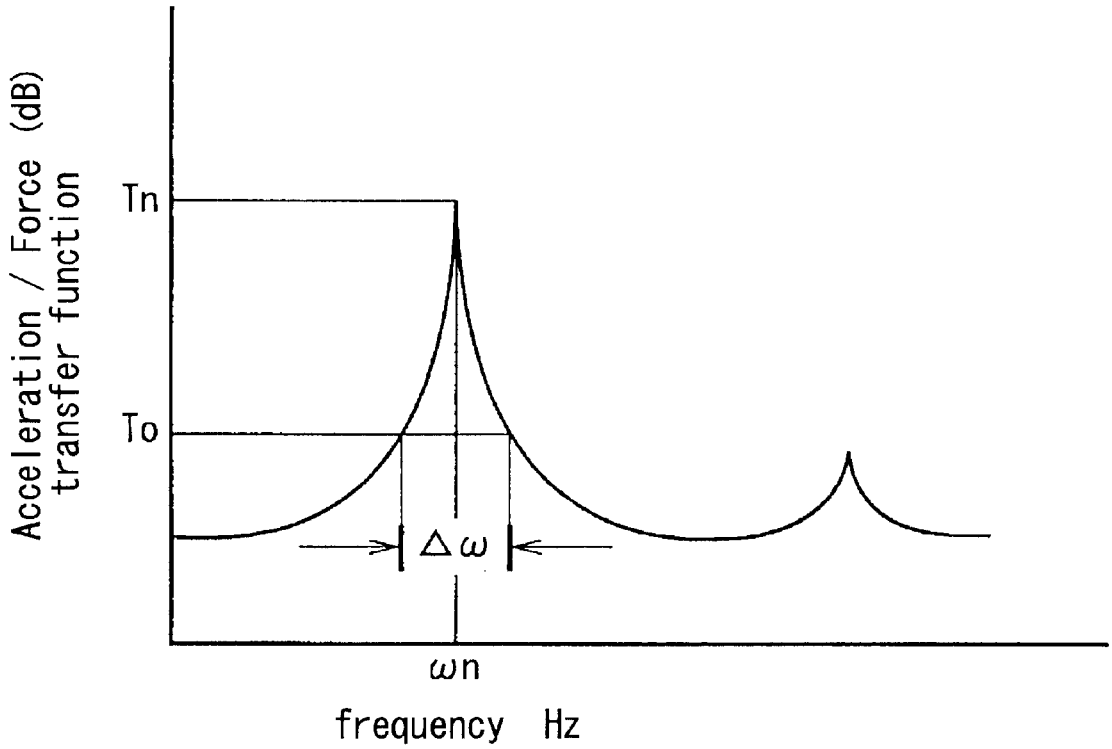
FIG. 18 is a graph showing the relationship between a frequency and a transmission function.
Figure 19:
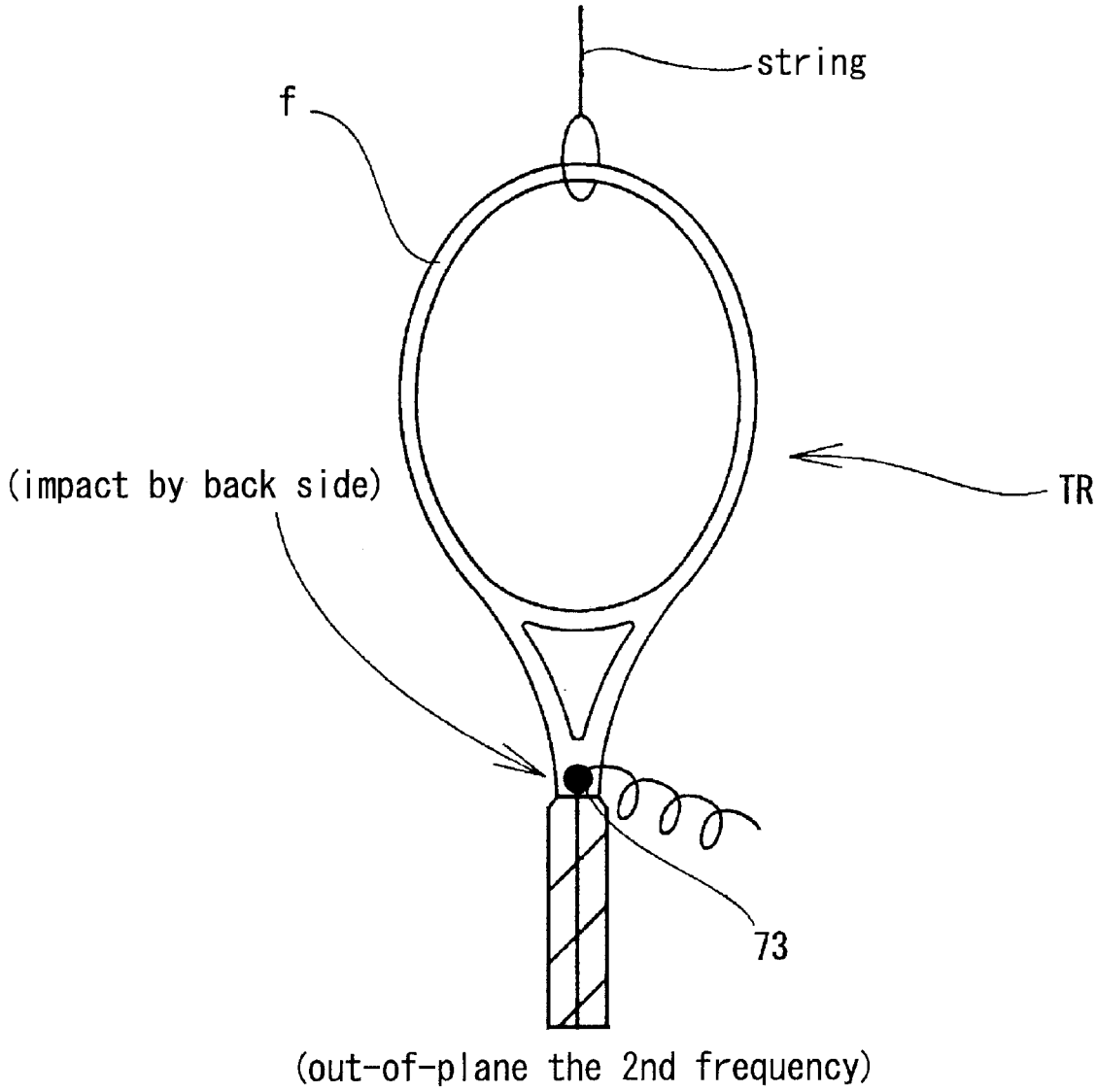
FIG. 19 is a schematic view showing a measuring position for a frequency in an out-of-plane the 2nd mode.
Figure 20:
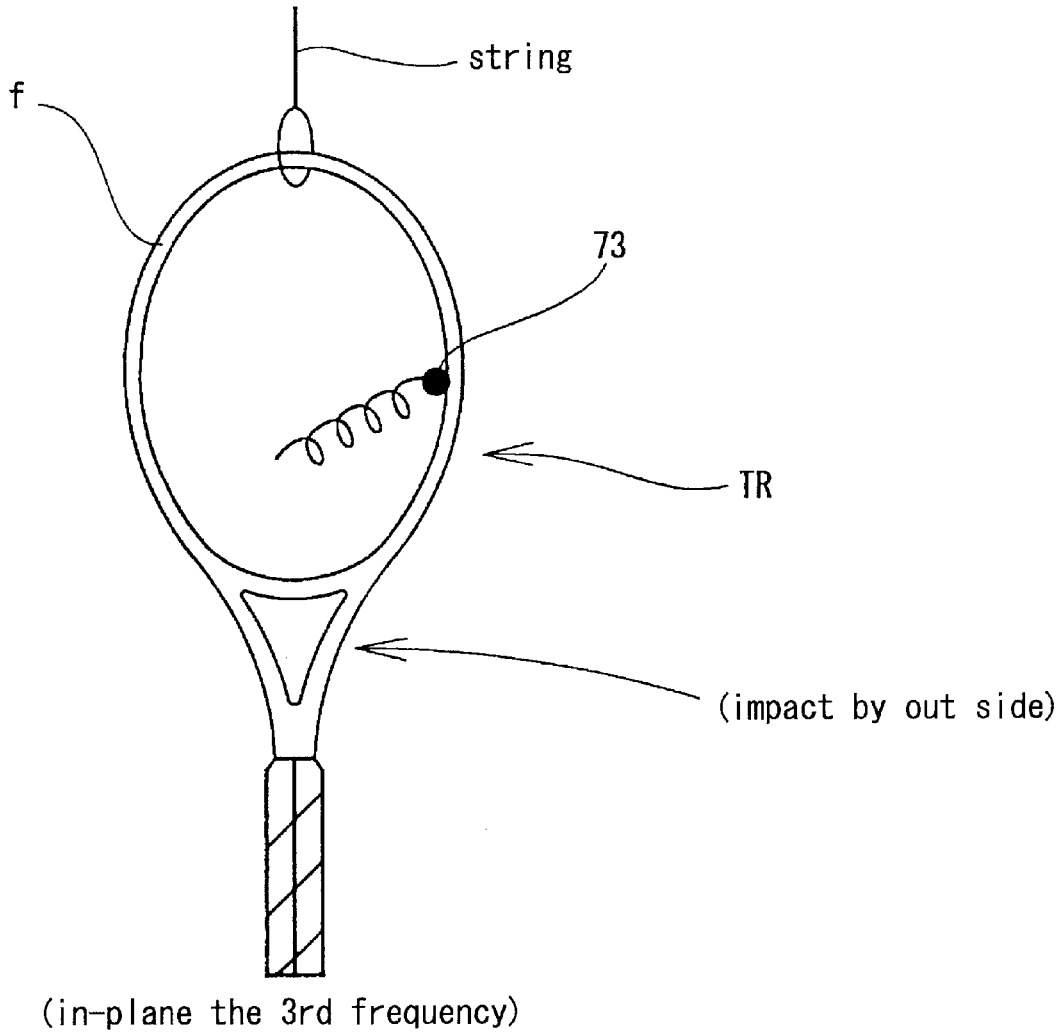
FIG. 20 is a schematic view showing a measuring position for a frequency in an in-plane the 3rd mode.

The method of measuring the natural frequency of each of the tennis rackets TR and the damping factors thereof is shown in FIGS. 17 and 18. To measure them with high accuracy, an acceleration pick-up meter 73 was mounted on a maximum amplitude position of the tennis racket TR in each vibration mode. In this state, the maximum amplitude position of the tennis racket TR was hit with an impact hammer 71 to generate vibrations of the tennis racket TR. No gut was stretched on the gut-stretched part of the racket frame f. As shown in FIGS. 19 and 20, the natural frequency of the tennis racket TR and its damping factor were measured by a free supporting method of hanging the tennis racket TR with a string. An input vibration (F) measured with a force pick-up meter installed on the impact hammer 71 and a response vibration ($\alpha$) measured with the acceleration pick-up meter 73 were inputted to a frequency analyzer 74 (manufactured by Hewlett Packard Corp., dynamic single analyzer HP 3562A) through amplifiers 72 and 70 to analyze the input vibration (F) and the response vibration ($\alpha$) This method was carried out by supposing that the rigidity of the racket frame f was linear.

A transfer function, in a frequency region, obtained by the determined danalysis in order to obtain the out-of-plane the 2nd frequency and the in-plane the 3rd frequency of the racket frame f. The vibration-damping ratio ($\zeta$) was computed with reference to FIG. 18 by using the following equation:

$$\zeta=(1/2)\times(\Delta\omega/\omega n)$$

$$To=Tn/\sqrt{2}$$

Figure 21A:
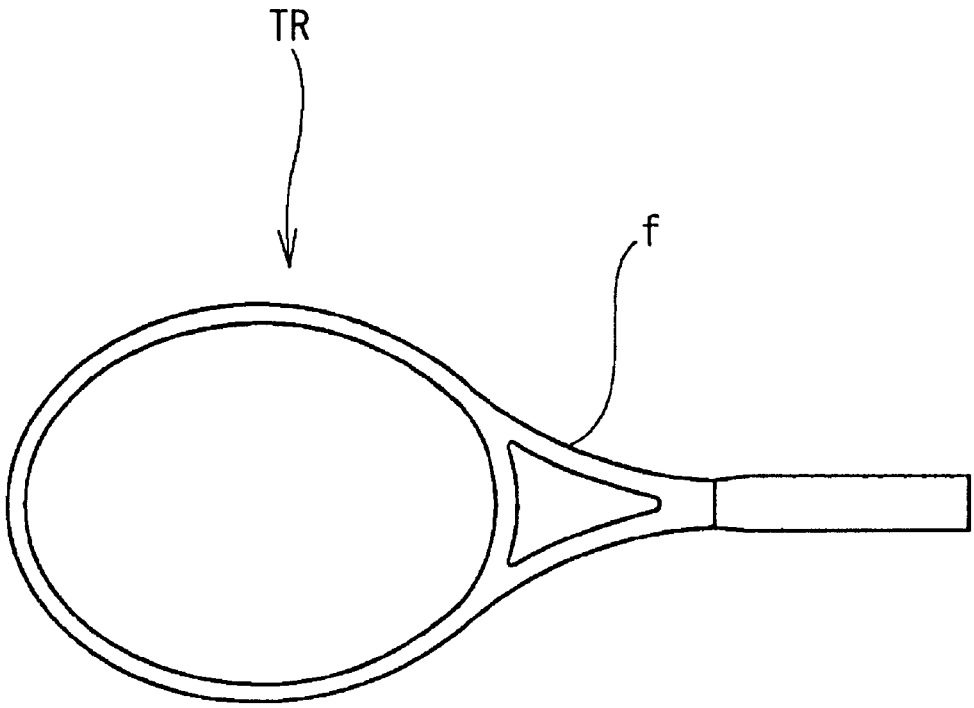
FIGS. 21A and 21B are an explanatory view respectively for explaining an out-of-plane the 2nd mode of a tennis racket.
Figure 21B:
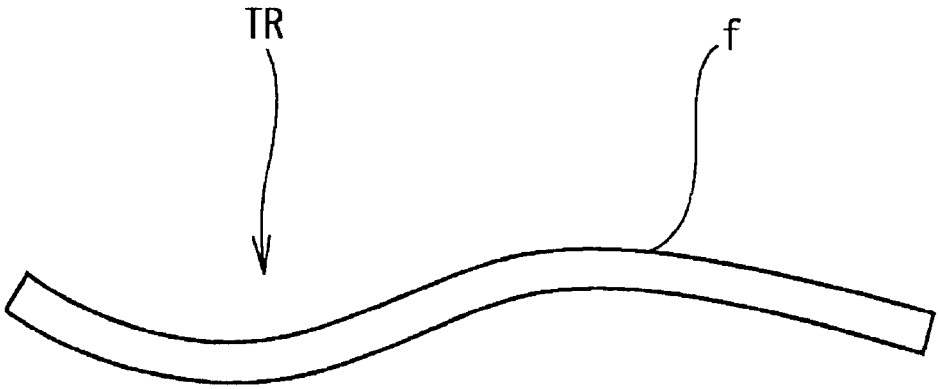

As shown in FIG. 19, the out-of-plane the 2nd frequency is the 2nd peak which appear with respect to a low frequency when the tennis racket TR set in a free supporting state of hanging the tennis racket TR with a string is hit on its back. More specifically, the out-of-plane 2nd frequency is a frequency at the time when the tennis racket TR (before deformation) vibrates in the out-of-plane 2nd mode, as shown in FIG. 21B (side view of the tennis racket).

Figure 22A:
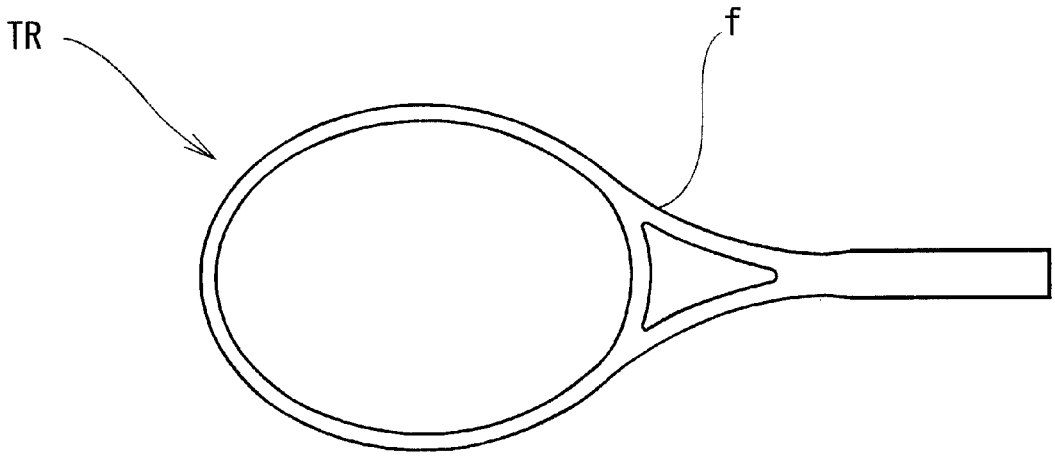
FIGS. 22A and 22B are an explanatory view respectively for explaining an in-plane the 3rd mode of the tennis racket.
Figure 22B:
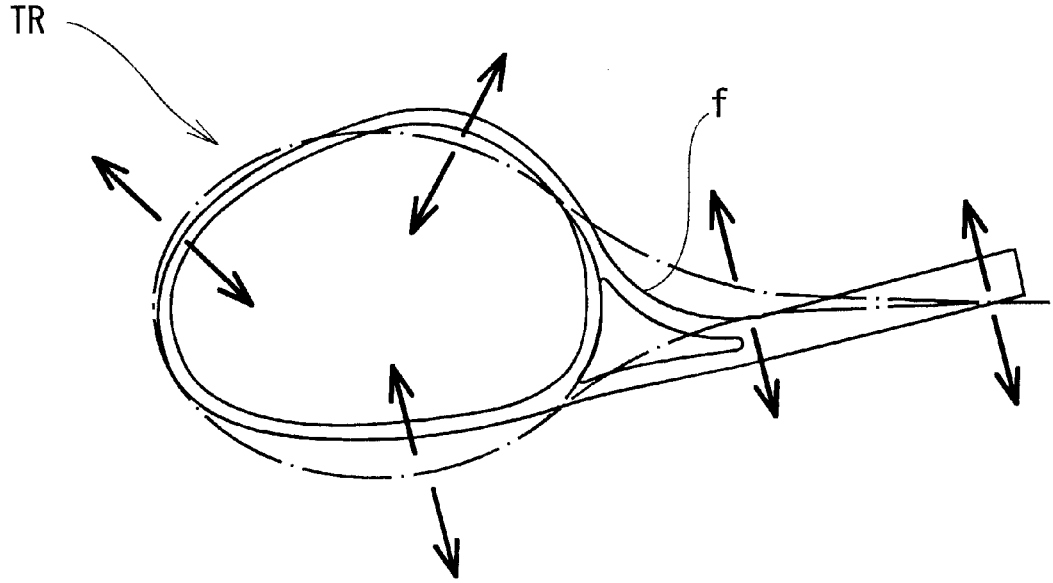
Figure 23:
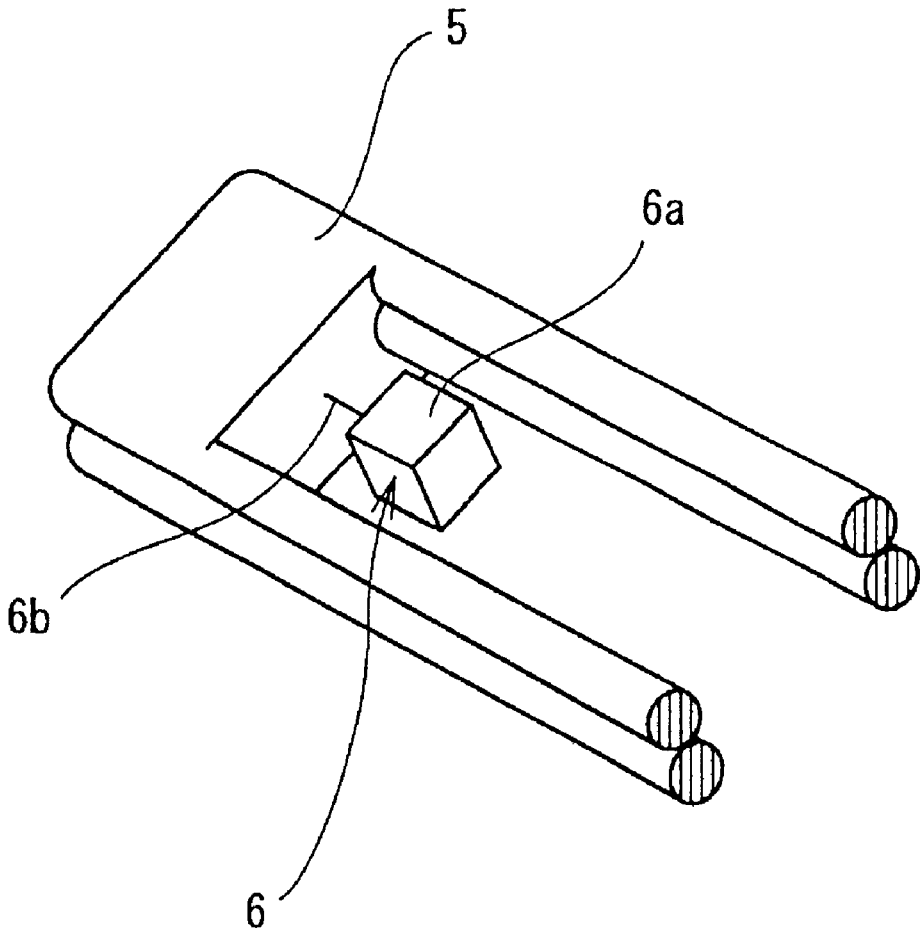
FIG. 23 shows a conventional art.
Figure 24:
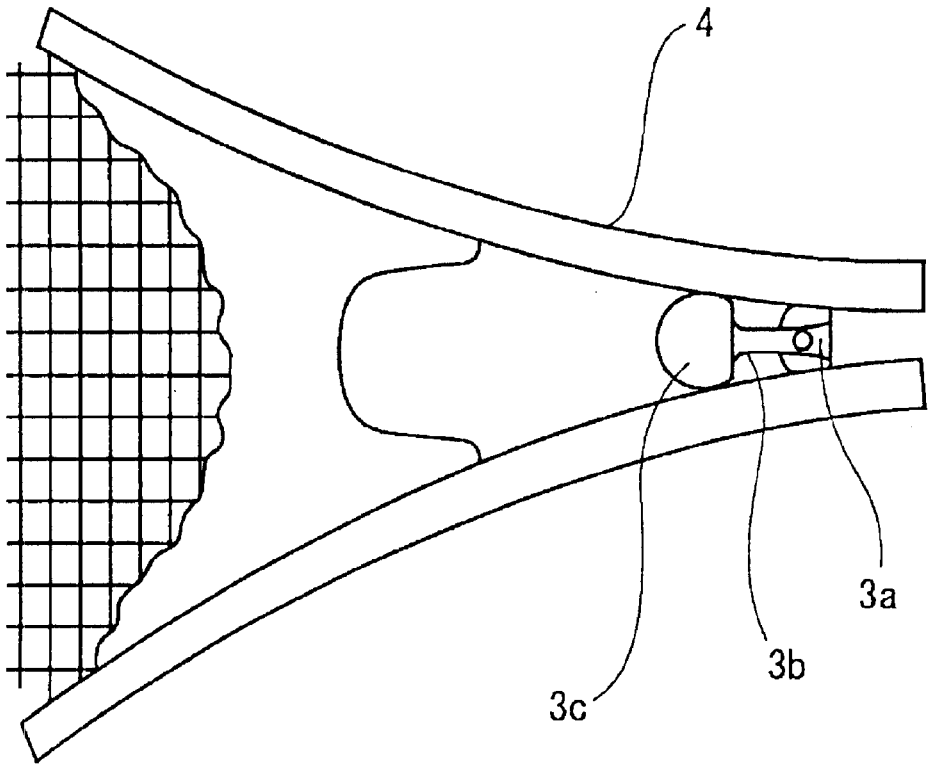
FIG. 24 shows another conventional art.
Figure 25:
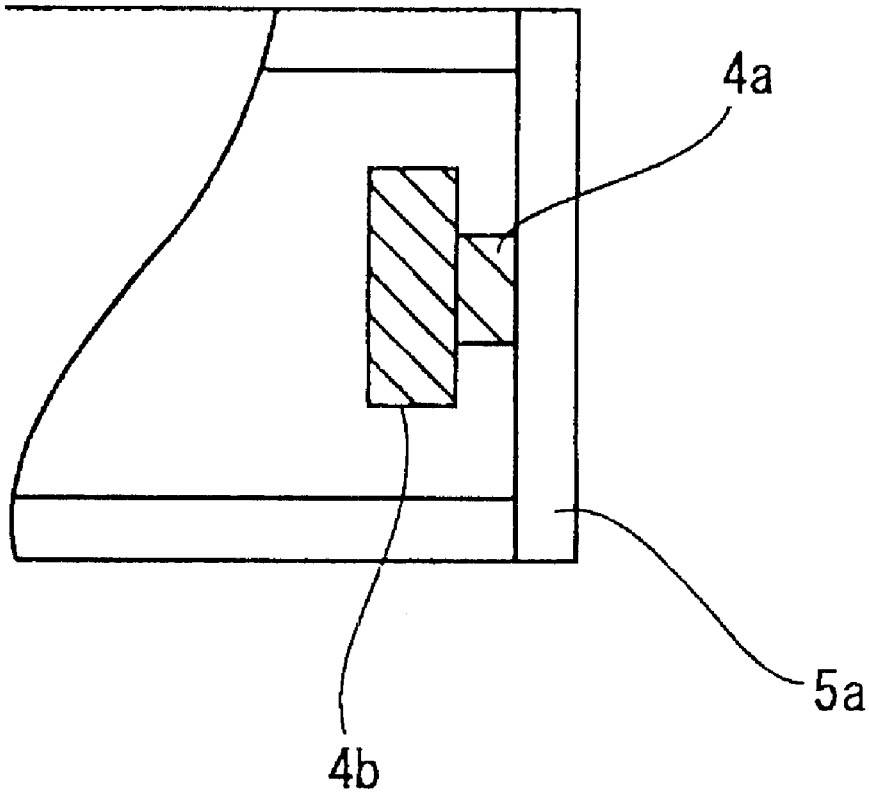
FIG. 25 shows still another conventional art.

As shown in FIG. 20, the in-plane the 3rd frequency is the 3rd peak which appear with respect to the low frequency when the tennis racket TR set in a free supporting state of hanging the tennis racket TR with a string is hit from the outside. More specifically, the in-plane 3rd frequency is a frequency (before deformation), shown in FIG. 22A, at the time when the tennis racket TR vibrates (deforms) in the in-plane 3rd mode, as shown in FIG. 22B.

Evaluation on Frequency 30 middle and high class players hit balls with the tennis rackets of the examples 1–7 and the comparison examples 1–3 to evaluate them on the basis of five. The tennis racket which had least vibrations was marked as "5", whereas the tennis racket which had most vibrations was marked as "1". The evaluation was made by computing the average of the marks given by the 30 players.

Table 2 shows the configuration of the dynamic damper of each of the examples 1–7 and the comparison examples 1–3, the length-to-breadth ratio of the lattice, the installing position of the dynamic damper on the tennis racket, the weight of the dynamic damper, measured frequency and damping ratio, and evaluated results.

TABLE 2

| Configuration | E1 Lattice-shaped and integral | E2 Lattice-shaped and integral | E3 Lattice-shaped and integral | E4 Lattice-shaped and integral | E5 Lattice-shaped and separate | E6 Long and narrow | CE1 U-shaped | CE2 Long and narrow | E7 Lattice-shaped and integral | CE3 Lattice-shaped and integral |
|---|---|---|---|---|---|---|---|---|---|---|
| length-to-breadth ratio | 0.38 | 0.64 | 0.9 | 0.64 | — | — | — | — | 0.29 | 1.16 |
| Installing position of dynamic damper on racket | 3 & 9 o' clock | 3 & 9 o' clock | 3 & 9 o' clock | 5 and 7 o' clock | 3 & 9 o' clock | 3 & 9 o' clock | 3 & 9 o' clock | 3 & 9 o' clock | 3 & 9 o' clock | 3 & 9 o' clock |
| Weight(g) of dynamic damper | 8.1 | 12.2 | 16.6 | 12.2 | 9.4 | 10.9 | 10.2 | 8.8 | 7.4 | 21 |
| Out-of-plane the 2nd frequency (Hz) | 422 | 421 | 420 | 431 | 423 | 424 | 422 | 424 | 426 | 429 |

TABLE 2-continued

| Configuration | E1 Lattice-shaped and integral | E2 Lattice-shaped and integral | E3 Lattice-shaped and integral | E4 Lattice-shaped and integral | E5 Lattice-shaped and separate | E6 Long and narrow | CE1 U-shaped | CE2 Long and narrow | E7 Lattice-shaped and integral | CE3 Lattice-shaped and integral |
|---|---|---|---|---|---|---|---|---|---|---|
| Out-of-plane the 2nd ratio damping (%) | 2.38 | 3.21 | 4.6 | 1.06 | 1.16 | 1.61 | 0.63 | 1.66 | 1.01 | 1.74 |
| In-plane the 3rd frequency (Hz) | 374 | 372 | 370 | 391 | 380 | 375 | 374 | 384 | 392 | 394 |
| In-plane the 3rd ratio damping (%) | 3.62 | 5.3 | 5.8 | 1.43 | 1.32 | 1.74 | 1.74 | 0.95 | 2.81 | 0.97 |
| Evaluated mark on vibration | 3.8 | 4.2 | 4.4 | 3.5 | 3.3 | 3.1 | 2.7 | 2.1 | 3.0 | 2.5 |

where E denotes example, and CE denotes comparison example.

As shown in table 2, the tennis rackets of the examples 1–7, had the out-of-plane the 2nd damping ratio and the in-plane the 3rd damping ratio at more than 1%. The tennis racket of each of the examples 2 and 3 had a much larger out-of-plane the 2nd damping ratio and in-plane the 3rd damping ratio than those of the other examples and the comparison examples. This is because in the tennis racket of each of the examples 2 and 3, the dynamic damper was lattice-shaped and integrally molded, the length-to-breadth ratio was more than 0.6 nor more than 0.9, and bonded to the three and nine o'clock positions. That is, the tennis racket of each of the examples 2 and 3 had the vibration-damping performance much superior to that of the tennis rackets of the other examples and the comparison examples and more favorable evaluation marks given on the vibration thereof than evaluation marks given on the vibration of the tennis rackets of the other examples and the comparison examples.

The dynamic damper of the comparison example 1 composed of the widthwise U-shaped parts had an in-plane 3rd damping ratio higher than 1% but a low out-of-plane 2nd damping factor. The dynamic damper of the comparison example 2 composed of the longitudinal long and narrow parts had an out-of-plane 2nd damping factor higher than 1% but a low in-plane 3rd damping factor. The dynamic damper of the comparison example 3 had a length-to-breadth ratio of 1.16 and a low in-plane the 3rd damping ratio. Because the length-to-breadth ratio was much greater than one, the entire dynamic damper did not vibrate and in particular in the in-plane direction.

The dynamic damper having only the U-shaped part or only the long and narrow part and not having apart which resonates with the racket frame in the out-of-plane direction and the in-plane direction was incapable of reducing the vibration in the out-of-plane direction and the in-plane direction effectively.

As apparent from the foregoing description, it was confirmed that the dynamic damper having the U-shaped horizontal frame and the long and narrow vertical frame integrally or separately in the shape of a lattice was excellent in the vibration-damping performance in the out-of-plane direction and the in-plane direction.

The lattice-shaped dynamic damper of the present invention has the long and narrow vertical frame integral with the U-shaped horizontal frame or separate vertical frame and horizontal frame are jointed with each other.

As described above, according to the present invention, regarding the configuration of the dynamic damper, the horizontal frame and the vertical frame are continuous and integral with each other or the horizontal frame and the vertical frame separate from each other are joined with each other in the shape of a lattice. Therefore in the dynamic damper-installed racket, the vertical frame resonates mainly with vibrations of the racket frame in a out-of-plane direction, whereas the horizontal frame resonates mainly with vibrations of the racket frame in a in-plane direction, thus effectively reducing vibrations in the out-of-plane direction and the in-plane direction.

In the case where the dynamic damper is formed monolithically in the shape of a lattice, i.e., in the case where the vertical frame and the horizontal frame are formed integrally with each other in the shape of a lattice, the entire lattice resonates with the vibration of the racket frame in the in-plane direction, thus having an effect of reducing the vibration in the in-plane direction. That is, in the case where the horizontal frame and the vertical frame are formed integrally with each other in the shape of a lattice, the weight of the entire dynamic damper contributes to the reduction of the vibration of the racket frame in the in-plane direction and the out-of-plane direction, thus having a higher vibration reduction effect than that brought about by the horizontal frame contributing to the reduction of the vibration of the racket frame in the in-plane direction and the vertical frame contributing to the reduction of the vibration thereof in the out-of-plane direction. That is, the dynamic damper having the construction is superior in its vibration-damping performance.

The dynamic damper of the present invention installed on the tennis racket is capable of reducting vibrations in the out-of-plane direction and the in-plane direction efficiently without reducing the handling performance of the tennis racket and allows for an out-of-plane 2nd damping ratio and an in-plane 3rd damping ratio of the racket frame to be not less than 1%. Thus the dynamic damper prevents a player from feeling uncomfortable when he hits a ball with the tennis racket. Further when the player hits a ball at the off-center area, the dynamic damper is capable of preventing rotation of the racket and reducing the degree of burden applied to the player's elbow.

The three o'clock position and the nine o'clock position are maximum amplitude positions of the in-plane vibration and the out-of-plane 2nd vibration. Thus the installation of the dynamic damper of the present invention at the three o'clock position and the nine o'clock position is optimum for reducing vibrations in the in-plane and out-of-plane directions and reducing shock caused by the rotation of the grip.

What is claimed is:

1. A dynamic damper which comprises a viscoelastic part and a mass-adding part laminated on said viscoelastic part and is installed on a racket, said dynamic damper having a horizontal frame and a vertical frame disposed at both sides of said horizontal frame in the shape of a lattice, wherein said horizontal frame and said vertical frame are integrally formed or formed by joining separate members with each other, said horizontal frame is installed on at least one surface of said racket in a thickness direction thereof, and said vertical frame is installed on both surfaces of said racket in a widthwise direction thereof; and wherein said horizontal frame is bent in a shape of a letter "U"; one end of a bent portion disposed at both sides of said horizontal frame is integral with said vertical frame or joined therewith; said bent portion disposed at both sides of said horizontal frame is installed on both surfaces of said racket in a widthwise direction thereof and the number of said horizontal frames is not less than two.

2. The dynamic damper according to claim 1, wherein said horizontal frames sandwich an insertion hole therebetween.

3. The dynamic damper according to claim 2, wherein a ratio (L2/L1) of a length (L2) of said vertical frame to a length (L1) of said horizontal frame is set to not less than 0.3 nor more than 1.0;

a width of each portion of said viscoelastic part is set to not less than 4 mm nor more than 8 mm;

a thickness of each portion of said viscoelastic part is set to not less than 2.5 mm nor more than 5.5 mm; and a total weight of said dynamic damper is set to not less than 8 g nor more than 23 g.

4. The dynamic damper according to claim 3, wherein a complex elastic modulus of said viscoelastic part at 20° C. and 10 Hz is set to not less than 0.3 MPa nor more than 1.5 MPa; and a complex elastic modulus of said mass-adding part at 20° C. and 10 Hz is set to not less than 100 MPa nor more than 800 MPa.

5. The dynamic damper according to claim 2, wherein a complex elastic modulus of said viscoelastic part at 20° C. and 10 Hz is set to not less than 0.3 MPa nor more than 1.5 MPa; and a complex elastic modulus of said mass-adding part at 20° C. and 10 Hz is set to not less than 100 MPa nor more than 800 MPa.

6. The dynamic damper according to claim 1, wherein a ratio (L2/L1) of a length (L2) of said vertical frame to a length (L1) of said horizontal frame is set to not less than 0.3 nor more than 1.0;

a width of each portion of said viscoelastic part is set to not less than 4 mm nor more than 8 mm;

a thickness of each portion of said viscoelastic part is set to not less than 2.5 mm nor more than 5.5 mm; and a total weight of said dynamic damper is set to not less than 8 g nor more than 23 g.

7. The dynamic damper according to claim 6, wherein a complex elastic modulus of said viscoelastic part at 20° C. and 10 Hz is set to not less than 0.3 MPa nor more than 1.5 MPa; and a complex elastic modulus of said mass-adding part at 20° C. and 10 Hz is set to not less than 100 MPa nor more than 800 MPa.

8. The dynamic damper according to claim 1, wherein a complex elastic modulus of said viscoelastic part at 20° C. and 10 Hz is set to not less than 0.3 MPa nor more than 1.5 MPa; and a complex elastic modulus of said mass-adding part at 20° C. and 10 Hz is set to not less than 100 MPa nor more than 800 MPa.

9. The dynamic damper according to claim 1, wherein the number of said horizontal frames is not less than two; and said horizontal frames are disposed, with said horizontal frames sandwiching an insertion hole therebetween.

10. The dynamic damper according to claim 9, wherein a ratio (L2/L1) of a length (L2) of said vertical frame to a length (L1) of said horizontal frame is set to not less than 0.3 nor more than 1.0;

a width of each portion of said viscoelastic part is set to not less than 4 mm nor more than 8 mm;

a thickness of each portion of said viscoelastic part is set to not less than 2.5 mm nor more than 5.5 mm; and a total weight of said dynamic damper is set to not less than 8 g nor more than 23 g.

11. The dynamic damper according to claim 10, wherein a complex elastic modulus of said viscoelastic part at 20° C. and 10 Hz is set to not less than 0.3 MPa nor more than 1.5 MPa; and a complex elastic modulus of said mass-adding part at 20° C. and 10 Hz is set to not less than 100 MPa nor more than 800 MPa.

12. The dynamic damper according to claim 9, wherein a complex elastic modulus of said viscoelastic part at 20° C. and 10 Hz is set to not less than 0.3 MPa nor more than 1.5 MPa; and a complex elastic modulus of said mass-adding part at 20° C. and 10 Hz is set to not less than 100 MPa nor more than 800 MPa.

13. The dynamic damper according to claim 1, wherein a ratio (L2/L1) of a length (L2) of said vertical frame to a length (L1) of said horizontal frame is set to not less than 0.3 nor more than 1.0;

a width of each portion of said viscoelastic part is set to not less than 4 mm nor more than 8 mm;

a thickness of each portion of said viscoelastic part is set to not less than 2.5 mm nor more than 5.5 mm; and a total weight of said dynamic damper is set to not less than 8 g nor more than 23 g.

14. The dynamic damper according to claim 13, wherein a complex elastic modulus of said viscoelastic part at 20° C. and 10 Hz is set to not less than 0.3 MPa nor more than 1.5 MPa; and a complex elastic modulus of said mass-adding part at 20° C. and 10 Hz is set to not less than 100 MPa nor more than 800 MPa.

15. The dynamic damper according to claim 1, wherein a complex elastic modulus of said viscoelastic part at 20° C. and 10 Hz is set to not less than 0.3 MPa nor more than 1.5 MPa; and a complex elastic modulus of said mass-adding part at 20° C. and 10 Hz is set to not less than 100 MPa nor more than 800 MPa.

16. A tennis racket comprising a part surrounding a racket frame face with insertion holes, a throat part, a handle, and a dynamic damper installed on at least one portion of the part surrounding the face of the racket frame or/and at least one portion of the throat part of said tennis racket, wherein said dynamic damper has a viscoelastic part and a mass-adding part laminated on each other and is installed on at least one surface of said racket frame in a thickness direction thereof and both surfaces of said racket frame in a widthwise direction thereof; and said dynamic damper installed on said racket frame allows for an out-of-plane 2nd damping factor of said racket frame and an in-plane 3rd damping factor of said racket frame to be not less than 1%.

17. A tennis racket comprising a part surrounding a racket frame face with insertion holes, a throat part, a handle, and a dynamic damper installed on at least one portion of the part surrounding the face of the racket frame or/and at least one portion of the throat part of said tennis racket, wherein said dynamic damper has a viscoelastic part and a mass-adding part laminated on each other and is installed on at least one surface of said racket frame in a thickness direction thereof and both surfaces of said racket frame in a widthwise direction thereof; and said dynamic damper installed on said racket frame allows for an out-of-plane 2nd damping factor of said racket frame and an in-plane 3rd damping factor of said racket frame to be not less than 1% wherein, supposing that the top position of the part surrounding the face of the racket frame is 12 o'clock by defining the face of the racket frame as a face of a clock, the dynamic damper according to any one of claims 2–15 is installed on at least one portion within an angular range of ±15° with respect to a three o'clock position and on at least one portion within an angular range of ±15° with respect to a nine o'clock position.

18. A tennis racket comprising a part surrounding a racket frame face with insertion holes, a throat part, a handle, and a dynamic damper installed on at least one portion of the part surrounding the face of the racket frame or/and at least one portion of the throat part of said tennis racket, wherein said dynamic damper has a viscoelastic part and a mass-adding part laminated on each other and is installed on at least one surface of said racket frame in a thickness direction thereof and both surfaces of said racket frame in a widthwise direction thereof; and said dynamic damper installed on said racket frame allows for an out-of-plane 2nd damping factor of said racket frame and an in-plane 3rd damping factor of said racket frame to be not less than 1% wherein, supposing that the top position of the part surrounding the face of the racket frame is 12 o'clock by defining the face of the racket frame as a face of a clock, the dynamic damper according to any one of claims 2–15 is installed on at least one portion within an angular range of ±15° with respect to a four o'clock position and on at least one portion within an angular range of ±15° with respect to a eight o'clock position.

19. A tennis racket comprising a part surrounding a racket frame face with insertion holes, a throat part, a handle, and a dynamic damper installed on at least one portion of the part surrounding the face of the racket frame or/and at least one portion of the throat part of said tennis racket, wherein said dynamic damper has a viscoelastic part and a mass-adding part laminated on each other and is installed on at least one surface of said racket frame in a thickness direction thereof and both surfaces of said racket frame in a widthwise direction thereof; and said dynamic damper installed on said racket frame allows for an out-of-plane 2nd damping factor of said racket frame and an in-plane 3rd damping factor of said racket frame to be not less than 1% wherein, supposing that the top position of the part surrounding the face of the racket frame is 12 o'clock by defining the face of the racket frame as a face of a clock, the dynamic damper according to any one of claims 2–15 is installed on at least one portion within an angular range of ±15° with respect to a five o'clock position and on at least one portion within an angular range of ±15° with respect to a seven o'clock position.

* * * * *